US010128591B2

(12) United States Patent
Ouyang et al.

(10) Patent No.: US 10,128,591 B2
(45) Date of Patent: Nov. 13, 2018

(54) ELECTRICAL CONNECTOR

(71) Applicant: Intel Corporation, Santa Clara, CA (US)

(72) Inventors: Gong Ouyang, Olympia, WA (US); Kai Xiao, University Place, WA (US); Lu-Vong T. Phan, DuPont, WA (US)

(73) Assignee: Intel Corporation, Santa Clara, CA (US)

( * ) Notice: Subject to any disclaimer, the term of this patent is extended or adjusted under 35 U.S.C. 154(b) by 44 days.

(21) Appl. No.: 14/847,482

(22) Filed: Sep. 8, 2015

(65) Prior Publication Data

US 2017/0069988 A1 Mar. 9, 2017

(51) Int. Cl.

| | |
|---|---|
| ***H01R 29/00*** | (2006.01) |
| ***H01R 13/71*** | (2006.01) |
| ***H01R 12/70*** | (2011.01) |
| *H01R 12/71* | (2011.01) |
| *H01R 13/703* | (2006.01) |
| *H01R 24/60* | (2011.01) |

(52) U.S. Cl.

CPC ..... *H01R 12/7076* (2013.01); *H01R 13/71* (2013.01); *H01R 12/716* (2013.01); *H01R 13/7036* (2013.01); *H01R 24/60* (2013.01)

(58) Field of Classification Search

CPC .. H01R 12/7076; H01R 12/712; H01R 12/72; H01R 12/716; H01R 12/714; H01R 12/89; H01R 24/60; H01R 13/71; H01R 13/7036; H05K 7/1061; H05K 7/1069

USPC ..... 439/260, 261, 60–77, 91, 629–638, 188, 439/591, 592

See application file for complete search history.

(56) References Cited

U.S. PATENT DOCUMENTS

| | | | | |
|---|---|---|---|---|
| 4,445,735 | A * | 5/1984 | Bonnefoy | H01R 12/714 439/591 |
| 6,135,783 | A * | 10/2000 | Rathburn | H01R 13/2414 439/592 |
| 6,409,529 | B1 * | 6/2002 | Liu | H01R 13/2442 439/188 |
| 6,572,396 | B1 * | 6/2003 | Rathburn | H05K 7/1061 439/260 |
| 6,923,655 | B2 * | 8/2005 | Korsunsky | H01R 12/85 439/637 |
| 7,210,955 | B2 * | 5/2007 | Ringler | H01R 12/585 439/381 |
| 8,206,166 | B2 * | 6/2012 | Qu | H01R 12/7094 439/188 |
| 2012/0178275 | A1 * | 7/2012 | Shen | H01H 23/162 439/188 |
| 2014/0075748 | A1 * | 3/2014 | Hasse | H01R 12/716 29/825 |

(Continued)

*Primary Examiner* — Michael A Lyons
*Assistant Examiner* — Milagros Jeancharles
(74) *Attorney, Agent, or Firm* — Grossman, Tucker, Perreault & Pfleger, PLLC

(57) ABSTRACT

One embodiment provides an electrical connector. The electrical connector includes a housing defining a slot; and a pin. The pin includes a stub member comprising a first portion and a second portion, the first portion to couple to a first printed circuit board; and a movable member operable to engage the second portion of the stub member to create a conductive path, wherein the stub member is only engaged with the movable member when a second printed circuit board is inserted into the slot.

16 Claims, 12 Drawing Sheets

(56) References Cited

U.S. PATENT DOCUMENTS

2014/0162470 A1* 6/2014 Fricker ..... H01R 12/523
439/65
2015/0024622 A1* 1/2015 Jin ..... H01R 12/7029
439/355

* cited by examiner

ELECTRICAL CONNECTOR

FIELD

The present disclosure relates to connectors, in particular to, an electrical connector.

BACKGROUND

Electrical connectors may be used to removably couple a first printed circuit board (PCB) to a second PCB. The electrical connector may be soldered to the second PCB and may include a slot configured to receive the first PCB. The first PCB may then be coupled to the second PCB by inserting an edge region of the first PCB into the slot. The first PCB may be decoupled by removing the first PCB from the slot. The edge region of the first PCB may include a plurality of electrical contacts with each contact configured to couple to a corresponding pin included in the electrical connector.

For example, in computing systems, a processor, e.g., a central processing unit (CPU), may be mounted on a PCB. A plurality of electrical connectors configured to receive memory modules may also be mounted on the PCB. The memory modules may be dual inline memory modules (DIMMs) and each may include an edge region configured to fit into a slot in a corresponding electrical connector. The edge region of each DIMM may include a plurality of electrical contacts with each contact configured to couple to a corresponding pin included in the electrical connector. The electrical connector pins may be coupled to the processor via traces and vias included in the PCB.

BRIEF DESCRIPTION OF DRAWINGS

Features and advantages of the claimed subject matter will be apparent from the following detailed description of embodiments consistent therewith, which description should be considered with reference to the accompanying drawings, wherein:

Figure 1:
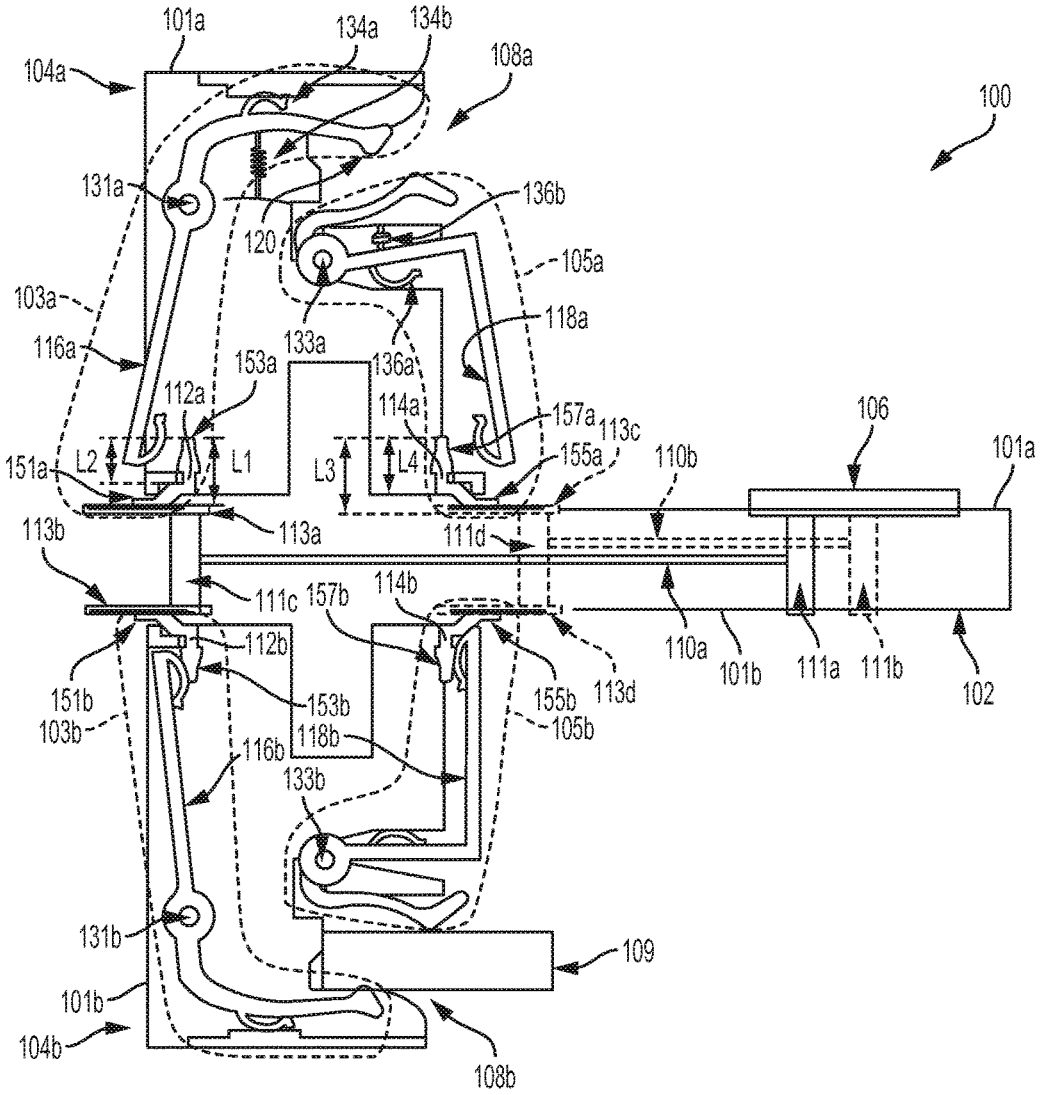
FIG. 1 illustrates a cross-section of an assembly consistent with several embodiments of the present disclosure.

Although the following Detailed Description will proceed with reference being made to illustrative embodiments, many alternatives, modifications, and variations thereof will be apparent to those skilled in the art.

DETAILED DESCRIPTION

In order to allow for expansion, the computing system may initially include fewer DIMMs than electrical connectors, thus, at least one electrical connector may be "unloaded". In other words, the slot of at least one electrical connector may not include a DIMM. The pins of the unloaded electrical connector remain coupled to the PCB traces and act as transmission lines that terminate in open circuits. Electrical signals on such transmission lines may be reflected by such open circuits resulting in detrimental effects at both the source and destination. An amount of the detrimental effects is related to a size (e.g., length) of the pins. Longer pins may produce a more pronounced effect. For example, two-DIMM memory topologies per channel include daisy chain or tree ("T") type. When one electrical connector is not loaded, the pins of the unloaded electrical connector may reflect signals back onto a memory channel and degrade the signal received by a processor and/or the coupled DIMM.

Generally, this disclosure relates to an electrical connector that includes a housing defining a slot and one or more electrical pins. Each electrical pin includes a stub member and a movable member. The stub member includes a first portion and a second portion. The first portion is configured to couple to a printed circuit board. The movable member is operable to engage the second portion to create a conductive path. The stub member is only engaged with the movable member when a printed circuit board, e.g., a DIMM, is inserted into the slot. A length of the stub member is configured to reduce and/or minimize effects of reflections when the electrical connector is unloaded. In other words, a length of the stub member is configured to reduce effects of reflections when the movable member and the stub member are not engaged. The stub member is configured to reduce an electrical length of a pin coupled to a PCB trace when the electrical connector is not loaded (i.e., is unloaded).

The movable member is configured to engage the stub member when a force is applied to the movable member. For example, the movable member may engage the stub member when a DIMM is inserted into a corresponding slot in the electrical connector. The movable member is further operable to disengage from the stub member if the force is removed. For example, the movable member may disengage from the stub member if the DIMM is removed from the electrical connector. As used herein, an electrical connector that is loaded has a DIMM inserted into a corresponding slot defined in the electrical connector. An electrical connector that is unloaded does not have a DIMM inserted in the slot. Although this disclosure describes example electrical connectors configured to receive DIMMs, electrical pins and/or electrical connectors consistent with the present disclosure may be configured to receive PCBs, in general, to minimize reflection effects from unloaded connectors and/or pins, as described herein.

A length of the stub member is configured to be less than a length of the pin, i.e., is less than a length of a combination of the stub member engaged with the movable member. The length of the stub may be minimized and may be constrained by considerations related to making an electrical contact with the movable member. A length of the movable member is relatively less constrained. The length and geometry of the movable member are related to overall pin length and electrical connector geometry. The reduced length of the stub member portion of the pin is configured to reduce effects of an unloaded electrical connector. For example, intersymbol interference may be reduced since reflected energy from the stub member may reach a corresponding source more quickly than reflected energy from the entire pin, e.g., during an incident pulse that produced the reflected energy.

FIG. 1 illustrates a cross-section of an assembly 100 consistent with several embodiments of the present disclosure. The assembly 100 includes a printed circuit board (PCB) 102, an unloaded electrical connector 104*a*, a loaded electrical connector 104*b* and integrated circuit module, e.g., a processor, 106. The electrical connectors 104*a*, 104*b* may be coupled to opposing surfaces of PCB 102. For example, the unloaded electrical connector 104*a* may be coupled to a first surface 101*a* of PCB 102 and the loaded electrical connector 104*b* may be coupled to an opposing second surface 101*b* of PCB 102. The unloaded electrical connector 104*a* includes a housing 101*a* that defines a slot 108*a*. The loaded electrical connector 104*b* includes a housing 101*b* that defines a slot 108*b*. The slot 108*a* in the unloaded electrical connector 104*a*, configured to receive a DIMM, does not have a DIMM inserted. The slot 108*b* in the loaded electrical connector 104*b* has a DIMM 109 inserted. The electrical connectors 104*a*, 104*b* are coupled to the processor via a plurality of traces and vias, for example, traces 110*a*, 110*b* and vias 111*a*, 111*b*, 111*c*, 111*d*.

The electrical connectors may be surface mount or through hole. Example electrical connectors 104*a*, 104*b* are surface mount and are coupled to PCB 102 by a plurality of pads, e.g., pads 113*a*, 113*b*, 113*c*, 113*d*. In a through hole configuration, each pad and/or via may be replaced by a plated through hole configured to receive a through hole pin. In the through hole configuration, each through hole pin may be integral with or connected to a stub member, as described herein.

The unloaded electrical connector 104*a* includes a plurality of top-row pins, e.g., top-row pin 103*a*, and a plurality of bottom-row pins, e.g., bottom-row pin 105*a*. The loaded electrical connector 104*b* includes a plurality of top-row pins, e.g., top-row pin 103*b*, and a plurality of bottom-row pins, e.g., bottom-row pin 105*b*. Top-row pin 103*a* includes a top stub member 112*a* and a top movable member 116*a* and bottom-row pin 105*a* includes a bottom stub member 114*a* and a bottom movable member 118*a*. Top-row pin 103*b* includes a top stub member 112*b* and a top movable member 116*b* and bottom-row pin 105*b* includes a bottom stub member 114*b* and a bottom movable member 118*b*.

Top stub member 112*a* includes a first portion 151*a* and a second portion 153*a* and bottom stub member 114*a* includes a first portion 155*a* and a second portion 157*a*. Similarly, top stub member 112*b* includes a first portion 151*b* and a second portion 153*b* and bottom stub member 114*b* includes a first portion 155*b* and a second portion 157*b*. The first portions 151*a*, 151*b*, 155*a*, 155*b* are configured to couple respective electrical connectors 104*a*, 104*b* to printed circuit board 102. For example, first portion 151*a* is configured to couple top stub member 112*a* to a pad, e.g., electrical contact, 113*a*. In another example, first portion 155*a* is configured to couple bottom stub member 114*a* to a pad, e.g., electrical contact 113*c*. Similarly, first portion 151*b* is configured to couple top stub member 112*b* to a pad, e.g., electrical contact, 113*b* and first portion 155*b* is configured to couple bottom stub member 114*b* to a pad, e.g., electrical contact 113*d*.

A shape of each stub member 112*a*, 112*b*, 114*a*, 114*b* is configured to facilitate placing and securely fixing each stub member in respective housings 101*a*, 101*b*. For example, each stub may include fixing features such as notches and/or each stub may be tapered. A shape of each stub member 112*a*, 112*b*, 114*a*, 114*b* is further configured to provide at least a minimum surface area for electrical contact with respective movable member 116*a*, 116*b*, 118*a*, 118*b* when engaged.

Trace 110*a* is coupled to the top stub member 112*a* of the first electrical connector 104*a* and the top stub member 112*b* of second electrical connector 104*b* by via 111*c*. Trace 110*b* is coupled to the bottom stub member 114*a* of the first electrical connector 104*a* and the bottom stub member 114*b* of second electrical connector 104*b* by via 111*d*. Top stub member 112*a* is disengaged from the top movable member 116*a* and bottom stub member 114*a* is disengaged from the bottom movable member 118*a* of the first electrical connector 104*a*. As used herein, "top" and "bottom" refer to pins configured to contact opposing surfaces of, for example, a DIMM and thus, are not meant to constrain orientation in space.

Each stub member 112*a*, 112*b*, 114*a*, 114*b* is only engaged with the respective movable member 116*a*, 116*b*, 118*a*, 118*b* when a printed circuit board, e.g., DIMM 109, is inserted into the respective slot 108*a*, 108*b*. For example, top movable member 116*a* is not engaged with the second portion 153*a* of top stub member 112*a* and bottom movable member 118*a* is not engaged with the second portion 157*a* of bottom stub member 114*a*. In other words, since there is not a printed circuit board, e.g., DIMM, inserted in slot 108*a*, top stub member 112*a* and bottom stub member 114*a* are not engaged with their respective movable members 116*a*, 118*a*. Top movable member 116*b* is engaged with the second portion 153*b* of top stub member 112*b* to form a conductive path and bottom movable member 118*b* is engaged with the second portion 157*b* of bottom stub member 114*b* to form a conductive path. In other words, since there is a printed circuit board, e.g., DIMM109, inserted in slot 108*b*, top stub member 112*b* and bottom stub member 114*b* are engaged with their respective movable members 116*b*, 118*b* to form a conductive path of the second electrical connector 104*b*. Thus, processor 106 may be coupled to DIMM 109 via the second electrical connector 104*b*, traces 110*a*, 110*b*, electrical contacts 113*b*, 113*d*, and vias 111*a*, 111*b*, 111*c*, 111*d*. Processor 106 may be further coupled to top and bottom stub members 112*a*, 114*a* via traces 110*a*, 110*b*, electrical contacts 113*a*, 113*b*, and the vias 111*a*, 111*b*, 111*c*, 111*d*.

A first length L1 of the top stub member 112*a* from soldering pad 113*a* (and/or PCB 102 top surface) to top stub member tip is less than a length of the top-row pin 103*a*. A second length L2 of the top stub member 112*a* is from a bottom surface of housing 101*a* to tip of top stub member 112*a*. A thickness of the stub members 112*a*, 112*b*, 114*a*, 114*b* and movable members 116*a*, 116*b*, 118*a*, 118*b* may be constrained by pin to pin pitch (i.e., spacing) and/or pin to housing 101*a*, 101*b* spacing. For example, stub member 112*a*, 112*b*, 114*a*, 114*b* thickness and/or movable member

116*a*, 116*b*, 118*a*, 118*b* thickness (i.e., pin thickness) may be in the range 125 to 250 micrometers (μm).

The lengths L1, L2 are configured to be at or near respective minimums in order to reduce and/or minimize reflections from top-row pin 103*a* when electrical connector 104*a* is unloaded. Similarly, a third length L3 of the bottom stub member 114*a* from soldering pad 113*c* (and/or PCB 102 top surface) to tip of the bottom stub member is less than a length of the bottom-row pin 105*a*. A fourth length L4 of the bottom stub member 114*a* is from a bottom surface of housing 101*a* to tip of bottom stub member 114*a*. The lengths L3, L4 are configured to be at or near respective minimums in order to reduce and/or minimize reflections from bottom-row pin 105*a* when electrical connector 104*a* is unloaded. Corresponding lengths of top stub member 112*b* are also L1 and L2 and corresponding lengths of bottom stub member 114*b* are also L3 and L4. In some embodiments, L1 may be equal to L3 and/or L2 may be equal to L4. For example, lengths L1 and/or L3 may be equal to 2.5 millimeters (mm) plus or minus a tolerance. In another example, lengths L2 and/or L4 may be equal to 1.5 mm plus or minus a tolerance. For example, the tolerance may be 0.1 mm. In other examples, L1 and/or L3 may be greater than or less than 2.5 mm and L2 and/or L4 may be greater than or less than 1.5 mm.

Lengths of movable members 116*a*, 118*a*, 116*b*, 118*b* may be any length sufficient to provide a conductive path between an inserted DIMM, e.g., DIMM 109, and respective stub members 112*a*, 114*a*, 112*b*, 114*b*. Lengths L1, L2 of stub members 112*a*, 112*b* and lengths L3, L4 of stub members 114*a*, 114*b* are configured to provide at least a minimum electrical contact surface for engagement with respective movable member 116*a*, 118*a*, 116*b*, 118*b*. Reflections produced by stub members 112*a*, 114*a* are independent of dimensions of respective movable members 116*a*, 118*a* when electrical connector 103*a* is unloaded. Thus, reflections may be reduced and/or minimized by selection of relatively small stub lengths L1 and L3.

Top movable members 116*a*, 116*b* may each be configured to pivot about a respective pivot point 131*a*, 133*a*. Similarly, bottom movable members 118*a*, 118*b* may each be configured to pivot about a respective pivot point 131*b*, 133*b*. For example, electrical connectors 104*a*, 104*b* may include respective pivot pins related to pivot points 131*a*, 133*a*, 131*b*, 133*b*, as described herein. In another example, movable members 116*a*, 116*b*, 118*a*, 118*b* may each include a respective pivot feature configured to facilitate rotation of the respective movable member, as described herein. In some embodiments, the movable members 116*a*, 116*b*, 118*a*, 118*b* may be configured to translate, as described herein.

Top movable members, e.g., movable member 116*a*, may include an elastic feature 134*a* and/or 134*b* located at or near a first end 120. Similarly, bottom movable members, e.g. movable member 118*a*, may include an elastic feature 136*a* and/or 136*b*. The elastic features are configured to allow a respective movable member to engage a respective stub member when a force is applied to the movable member and to cause the movable member to disengage from the stub member when the force is removed. For example, the elastic features 134*a*, 134*b*, 136*a*, 136*b* may include a spring, a flexible member (e.g., curved, generally circular, generally ellipsoidal), a circular coil structure, etc.

The elastic features 134*a*, 134*b*, 136*a* and/or 136*b* are configured to deform when a force is applied to the movable members 116*a*, 118*a*, e.g., when a DIMM is inserted into slot 108*a*. The elastic features 134*a*, 134*b*, 136*a* and/or 136*b* are further configured to relax (i.e., return to neutral) if the force is removed, e.g., if the DIMM is removed from the slot 108*a*. For example, the elastic features 134*a* and 136*a* are configured to compress when a force is applied to the movable members 116*a*, 118*a* and to decompress when the force is removed. In another example, the elastic features 134*b*, 136*b* are configured to extend when a force is applied to movable members 116*a*, 118*a* and to retract when the force is removed. When the elastic features 134*a*, 134*b*, 136*a* and/or 136*b* are relaxed, their respective movable members 116*a*, 118*a* are configured to be disengaged from their respective stub members 112*a*, 114*a*. As used herein, an elastic feature is configured to deform (e.g., compress or extend) when a force, e.g., a load, is applied and to return to its original shape (e.g., uncompress or retract) if the force, e.g., the load, is removed. The elastic features 134*a*, 134*b*, 136*a* and/or 136*b* may be further positioned to achieve a desired insertion force and/or a desired spacing between stub members 112*a*, 114*a* and respective movable members 116*a*, 118*a* when disengaged.

Housings 101*a*, 101*b* may be formed using injection molding, for example. Top stub members 112*a*, 112*b*, top movable members 116*a*, 116*b*, bottom stub members 114*a*, 114*b* and/or bottom movable stub members 118*a*,118*b* may be formed, for example, from a copper-alloy sheet. In another example, members 112*a*, 112*b*, 114*a*, 114*b*, 116*a*, 116*b*, 118*a*, 118*b* may be formed using metal extrusion. In some embodiments, contact surface(s) of one or more of members 112*a*, 112*b*, 114*a*, 114*b*, 116*a*, 116*b*, 118*a*, 118*b* may be plated with, for example, gold to improve coupling between a stub member and respective movable member. In some embodiments, a width dimension of stub members 112*a*, 114*a*, 112*b*, 114*b* may be selected to facilitate coupling between the stub member 112*a*, 114*a*, 112*b*, 114*b* and the respective movable member 116*a*, 118*a*, 116*b*, 118*b*.

It should be noted that each electrical connector 104*a*, 104*b* is configured to include a plurality of top-row pins and a plurality of bottom row pins. One top-row pin 103*a*, 103*b* and one bottom-row pin 105*a*, 105*b* are shown for each electrical connector 104*a*, 104*b* for ease of illustration.

Figure 2:
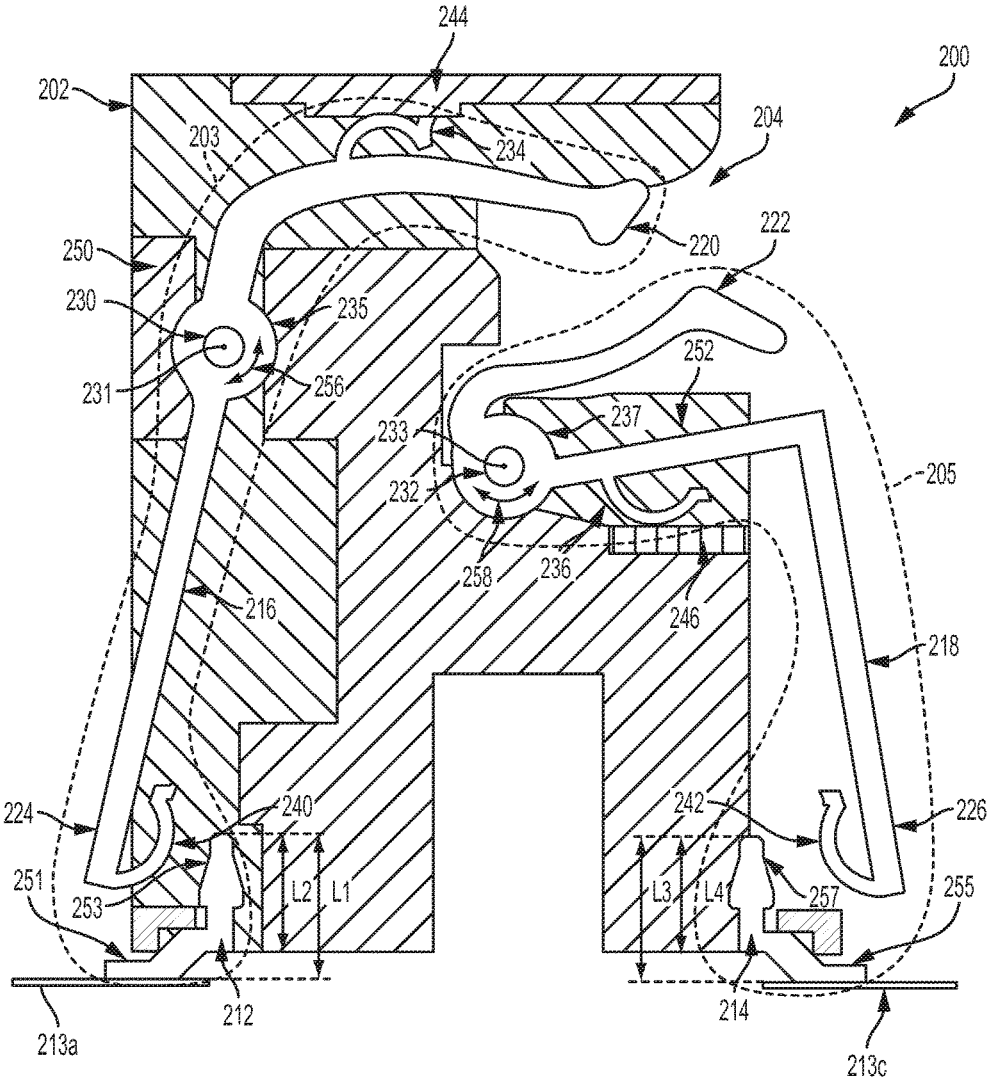
FIG. 2 illustrates a sectional view of an electrical connector consistent with one embodiment of the present disclosure.

FIG. 2 illustrates a sectional view of an electrical connector 200 consistent with one embodiment of the present disclosure. Electrical connector 200 is one example of electrical connectors 104*a*, 104*b* of FIG. 1. Electrical connector 200 includes a housing 202, a top-row pin 203 that includes a top stub member 212 and a top movable member 216 and a bottom-row pin 205 that includes a bottom stub member 214 and a bottom movable member 218. The housing 202 defines a slot 204 configured to receive a DIMM.

Top stub member 212 includes a first portion 251 and a second portion 253 and bottom stub member 214 includes a first portion 255 and a second portion 257. The first portions 251, 255 are configured to couple electrical connector 200 to a printed circuit board. For example, first portion 251 is configured to couple top stub member 212 to a pad, e.g., electrical contact, 213*a*. In another example, first portion 255 is configured to couple bottom stub member 214 to a pad, e.g., electrical contact 213*c*. Electrical contacts 213*a*, 213*c* correspond to pads 113*a*, 113*c* of printed circuit board 102 of FIG. 1.

Each stub member 212, 214 is only engaged with the respective movable member 216, 218 when a printed circuit board, e.g., a DIMM, is inserted into the slot 204. For example, top movable member 216 is not engaged with the second portion 253 of top stub member 212 and bottom movable member 218 is not engaged with the second portion 257 of bottom stub member 214. In other words, since there is not a DIMM inserted in slot 204, top stub member 212 and bottom stub member 214 are not engaged with their respective movable members 216, 218.

A length L1 of the top stub member 212 is less than a length of the top-row pin 203. Similarly, a length L3 of the bottom stub member 214 is less than a length of the bottom-row pin 205. Lengths L1, L2 of top stub member 212 and lengths L3, L4 of bottom stub member 218 are less than lengths of respective movable members 216, 218. Lengths of movable members 216, 218 may be any length sufficient to provide a conductive path between an inserted DIMM and respective stub members 212, 214. Lengths L1, L2, L3 and L4 are configured to reduce and/or minimize effects of reflections from unloaded electrical connectors, as described herein.

Top movable member 216 includes a first end 220 and a second end 224. Bottom movable member 218 includes a first end 222 and a second end 226. The top movable member 216 and the bottom movable member 218 are operable to engage respective second portions 253, 257 of stub members 212, 214 to create a conductive path. The first ends 220, 222 are positioned generally opposed and at least partially within the slot 204. The first ends 220, 222 may include and/or correspond to electrical contacts (i.e., contact regions) configured to couple to corresponding electrical contacts on, for example, a DIMM inserted in slot 204. Top movable member 216 is configured to engage the second portion 253 of top stub member 212 generally near the second end 224 and bottom movable member 218 is configured to engage the second portion 257 of bottom stub member 214 generally near the second end 226. The second ends 224, 226 may include and/or correspond to electrical contacts (i.e., contact regions) configured to electrically couple to respective second portions 253, 257 of stub members 212, 214.

Movable members 216, 218 are each configured to pivot, i.e., rotate in the directions of arrows 256, 258, about a respective pivot point 231, 233. For example, each pivot point 231, 233 may include a respective pivot pin 230, 232. The pivot pins 230, 232 may facilitate relatively more reliable rotation of movable members 216 and/or 218 about respective pivot points 231, 233. In another example, movable members 216, 218 may each include a respective pivot feature, e.g., circular pivot feature 235, 237, configured facilitate rotation about the pivot point 230, 232. For example, movable members 216, 218 may be configured to rotate through an angle of less than ten degrees. For example, movable members 216, 218 may be configured to rotate ±6 degrees. Housing 202 may define one or more cavity(ies) to accommodate pivot pins 230, 232 and/or pivot features 235, 237. Pivot pins 230, 232, if present, may be formed of and/or may be coated with an insulating material. Housing 202 may further include one or more retention feature(s) 250, 252 configured to hold respective pivot pins 230, 232 and/or pivot features 235, 237 in place.

Movable member 216 includes an elastic feature 234 located between the first end 220 and a pivot point, e.g., pivot pin 230. Similarly, movable member 218 includes an elastic feature 236 located between a pivot point, e.g., pivot point 232, and the second end 226. The elastic features 234, 236 are configured to compress when a force is applied to the movable members 216, 218, e.g., when a DIMM is inserted into slot 204. The elastic features 234, 236 are further configured to uncompress (i.e., relax) if the force is removed, e.g., if the DIMM is removed from the slot 204. When the elastic features 234, 236 are relaxed, their respective movable members 216, 218 are configured to be disengaged from their respective stub members 212, 214. For example, the elastic features 234, 236 may include a spring, a flexible member (e.g., curved, generally circular, generally ellipsoidal), a circular coil structure, etc. The elastic features 234, 236 may be positioned in housing 202 relative to respective rigid features 244, 246. The rigid features 244, 246 are configured to ensure that the elastic features 234, 236 compress as respective movable members 216, 218 rotate when a DIMM is inserted in slot 204. The elastic features 234, 236 may be further positioned to achieve a desired insertion force and/or a desired spacing between stub members 212, 214 and respective movable members 216, 218 when disengaged.

Movable members 216, 218 may further include elastic features 240, 242 at or near their respective second ends 224, 226. The elastic features 240, 242 are configured to be compressed by their respective stub members 212, 214 when the DIMM is inserted into slot 204 and the elastic features 240, 242 engage their respective stub members 212, 214. The elastic features 240, 242 are configured to uncompress if the DIMM is removed from the slot and the elastic features 240, 242 become disengaged from their respective stub members 212, 214. The elastic features 240, 242 are configured to facilitate engagement and/or electrical contact between movable members 216, 218 and their respective stub members 212, 214. For example, the elastic features 240, 242 may include and/or correspond to electrical contacts (i.e., contact regions) configured to electrically couple to respective stub members 212, 214. The elastic features are further configured to reduce a likelihood of stub member and/or movable member breakage during operation.

In operation, when a DIMM is inserted into slot 204, the DIMM may first contact the first end 222 of movable member 218 and may then contact the first end 220 of movable member 216. In some embodiments, one or more of the first end(s) 220 and/or 222 may include an elastic feature configured to facilitate insertion of and/or electrical contact with the DIMM. As the DIMM continues to move into the slot 204, movable member 216 is configured to rotate counter clockwise around the pivot 230 and movable member 218 is configured to rotate clockwise about pivot 232. Elastic features 234, 236 are configured to compress as their respective movable members rotate in response to the force resulting from the DIMM being inserted. As the DIMM moves further into the slot 204, movable members 216, 218 may rotate further until elastic features 240, 242 contact respective stub members 212, 214 and similarly compress.

Figure 3A:
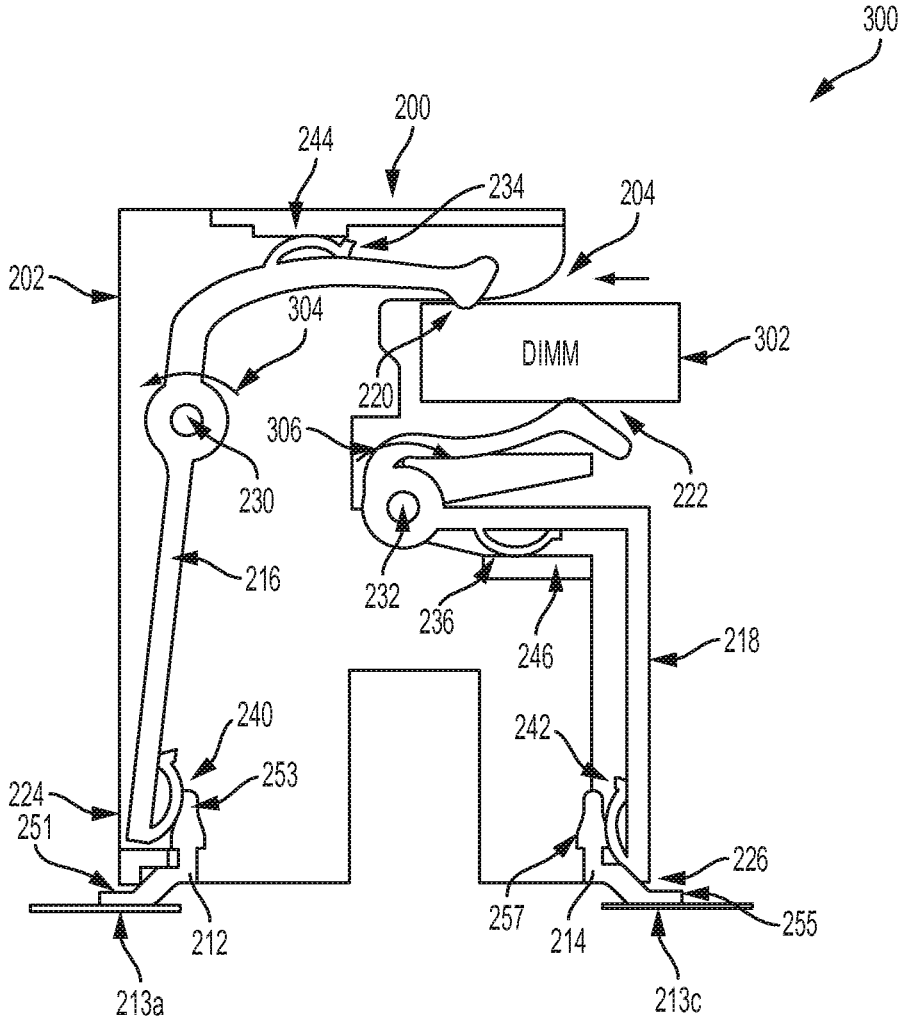
FIG. 3A illustrates one loaded example of the electrical connector of FIG. 2, consistent with one embodiment of the present disclosure.

FIG. 3A illustrates one loaded example 300 of the electrical connector 200 of FIG. 2, consistent with one embodiment of the present disclosure. Loaded example 300 includes electrical connector 200 and DIMM 302 inserted into the slot 204 of electrical connector 200. Top movable member 216 is engaged with top stub member 212 and bottom movable member 218 is engaged with bottom stub member 214. Top movable member 216 is engaged with the second portion 253 of top stub member 212 to create a conductive path and bottom movable member 218 is engaged with the second portion 257 of bottom stub member 214 to create a conductive path. In other words, since there is a printed circuit board, e.g., DIMM 302, inserted in slot 204, top stub member 212 and bottom stub member 214 are engaged with their respective movable members 216, 218 to form a conductive path of the electrical connector 200.

Elastic features 234, 236 are compressed between respective movable members 216, 218 and respective rigid features 244, 246. Arrows 304, 306 indicate direction of rotation of movable members 216, 218, respectively, as DIMM 302 is inserted in slot 204. Thus, in this loaded example, a top conductive path is created between DIMM 302 and contact 213*a* and a bottom conductive path is created between DIMM 302 and contact 213*c*. The top conductive path includes top movable member 216 and the first portion 251 and second portion 253 of top stub member 212. The bottom conductive path includes bottom movable member 218 and the first portion 255 and second portion 257 of bottom stub member 214.

Figure 3B:
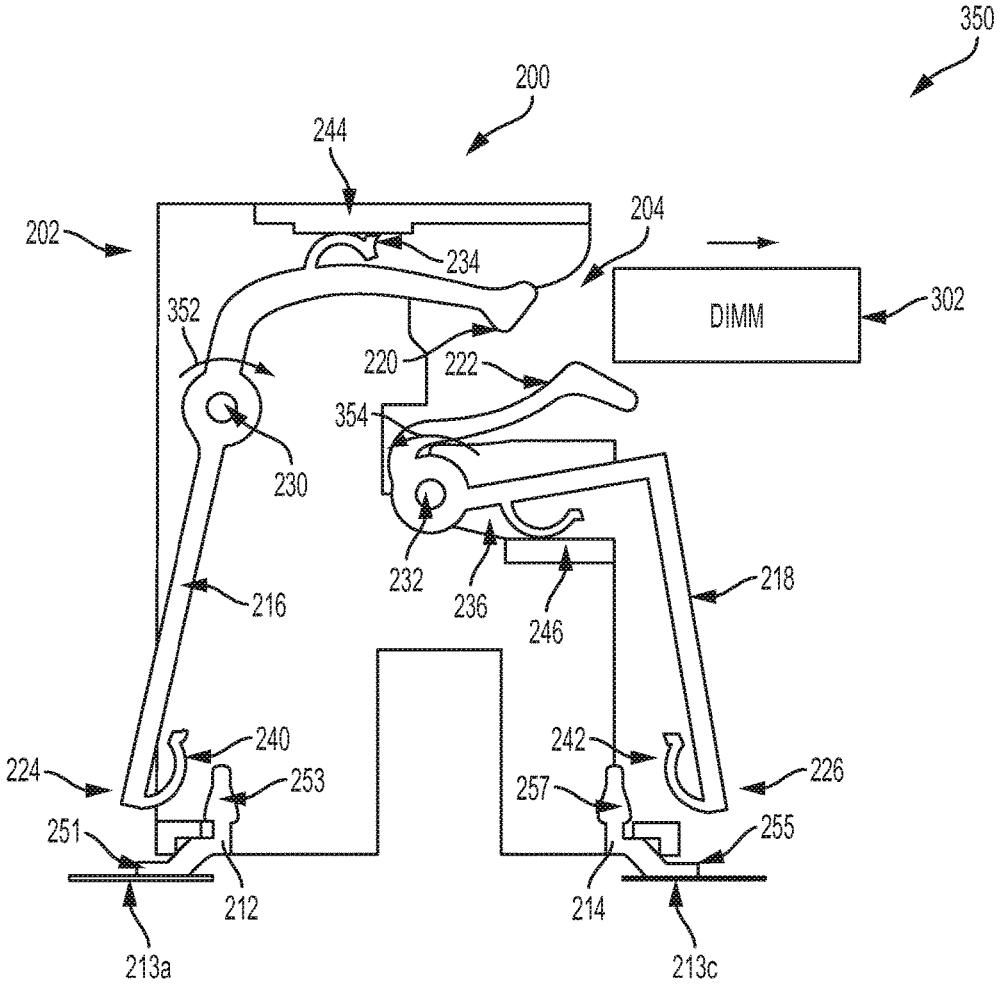
FIG. 3B illustrates an unloaded example of the electrical connector of FIG. 3A when the DIMM is removed from the slot, consistent with the present disclosure.

FIG. 3B illustrates an unloaded example 350 of the electrical connector of FIG. 3A when the DIMM is removed from the slot, consistent with the present disclosure. Unloaded example 350 includes electrical connector 200 and DIMM 302 after removal of DIMM 302 from the slot 204 of electrical connector 200. In this example, top movable member 216 is disengaged from top stub member 212 and bottom movable member 218 is disengaged from bottom stub member 214. Elastic features 234, 236 are uncompressed. Arrows 352, 354 indicate direction of rotation of movable members 216, 218, respectively, as DIMM 302 is removed from slot 204. Thus, in this unloaded example, top movable member 216 is not engaged with the second portion 253 of top stub member 212 and bottom movable member 218 is not engaged with the second portion 257 of bottom stub member 214. Thus, effects of reflections from top-row pin 203 and bottom-row pin 205 may be at least one of minimized and/or reduced when the DIMM 302 is removed from the slot 204.

Figure 4:
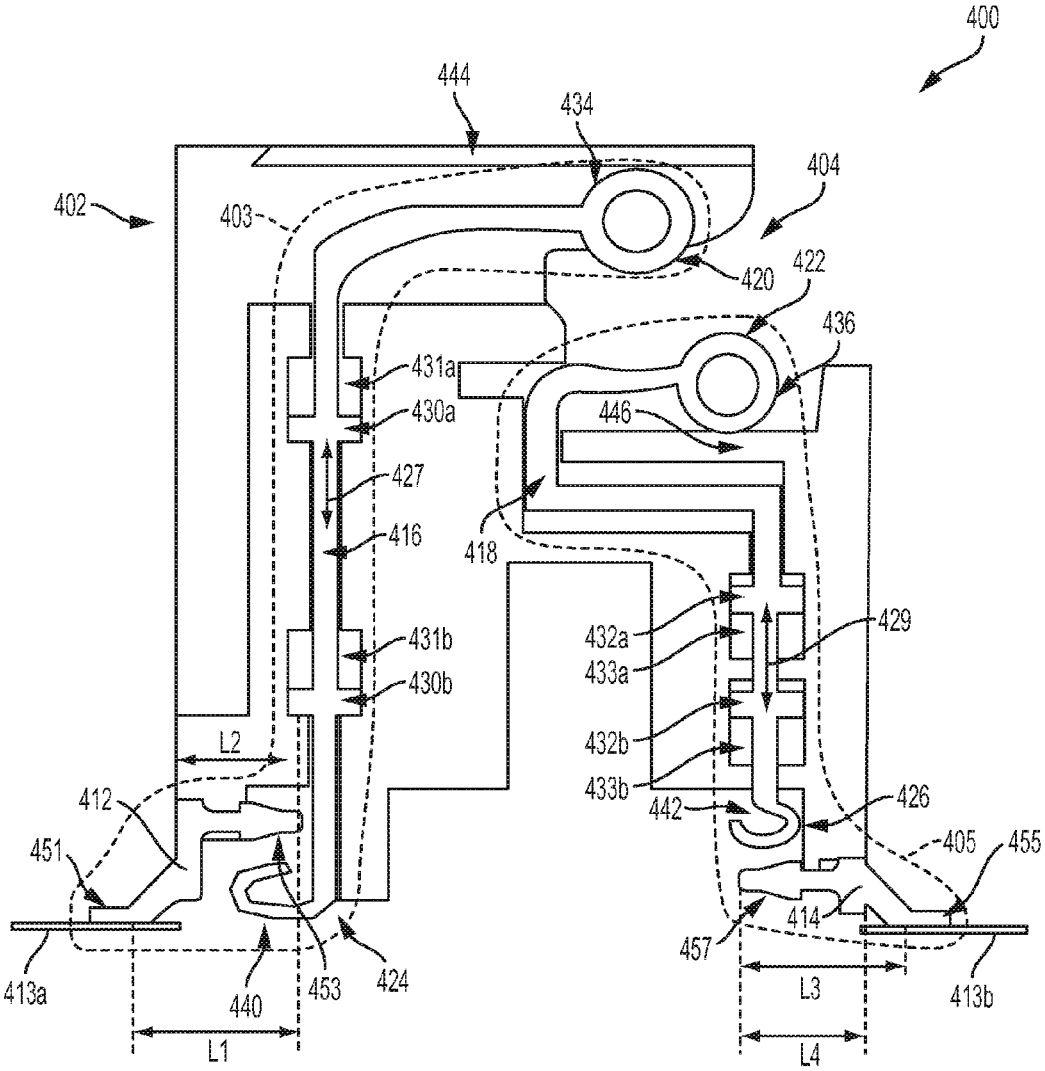
FIG. 4 illustrates a sectional view of another electrical connector consistent with one embodiment of the present disclosure.

FIG. 4 illustrates a sectional view of another electrical connector 400 consistent with one embodiment of the present disclosure. Electrical connector 400 is one example of electrical connectors 104*a*, 104*b* of FIG. 1. Electrical connector 400 includes a housing 402, a top-row pin 403 that includes a top stub member 412 and a top movable member 416 and a bottom-row pin 405 that includes a bottom stub member 414 and a bottom movable member 418. The housing 402 defines a slot 404 configured to receive a DIMM.

Top stub member 412 includes a first portion 451 and a second portion 453 and bottom stub member 414 includes a first portion 455 and a second portion 457. The first portions 451, 455 are configured to couple electrical connector 400 to a printed circuit board. For example, first portion 451 is configured to couple top stub member 412 to a pad, e.g., electrical contact, 413*a*. In another example, first portion 455 is configured to couple bottom stub member 414 to a pad, e.g., electrical contact 413*c*. Electrical contacts 413*a*, 413*c* correspond to pads 113*a*, 113*c* of printed circuit board 102 of FIG. 1.

Each stub member 412, 414 is only engaged with the respective movable member 416, 418 when a printed circuit board, e.g., a DIMM, is inserted into the slot 404. For example, top movable member 416 is not engaged with the second portion 453 of top stub member 412 and bottom movable member 418 is not engaged with the second portion 457 of bottom stub member 414. In other words, since there is not a DIMM inserted in slot 404, top stub member 412 and bottom stub member 414 are not engaged with their respective movable members 416, 418.

A length L1 of the top stub member 412 is less than a length of the top-row pin 403. Similarly, a length L3 of the bottom stub member 414 is less than a length of the bottom-row pin 405. Lengths L1, L2 of top stub member 412 and lengths L3, L4 of bottom stub member 418 are less than lengths of respective movable members 416, 418. Lengths of movable members 416, 418 may be any length sufficient to provide a conductive path between an inserted DIMM and respective stub members 412, 414. Lengths L1, L2, L3 and L4 are configured to reduce and/or minimize effects of reflections from unloaded electrical connectors, as described herein.

Top movable member 416 includes a first end 420 and a second end 424. Bottom movable member 418 includes a first end 422 and a second end 426. The top movable member 416 and the bottom movable member 418 are operable to engage respective second portions 453, 457 of stub members 412, 414 to create a conductive path. The first ends 420, 422 are positioned generally opposed within the slot 404. The first ends 420, 422 may include and/or correspond to electrical contacts (i.e., contact regions) configured to couple to corresponding electrical contacts on, for example, a DIMM inserted in slot 404. Top movable member 416 is configured to engage the second portion 453 of top stub member 412 generally near the second end 424 and bottom movable member 418 is configured to engage the second portion 457 of bottom stub member 414 generally near the second end 426. The second ends 424, 426 may include and/or correspond to electrical contacts (i.e., contact regions) configured to electrically couple to respective second portions 453, 457 of stub members 412, 414.

Movable members 416, 418 are each configured to translate, i.e., move in the directions of arrows 427, 429. As used herein, translate corresponds to motion along a straight line. Guide features 430*a*, 430*b*, 432*a*, 432*b* are configured to move in corresponding guide slots 431*a*, 431*b*, 433*a*, 433*b* defined in housing 402. The translation movement of top movable member 416 may be guided and/or limited by guide features 430*a*, 430*b* and/or guide slots 431*a*, 431*b*. Similarly, the translation motion of bottom movable member 418 may be guided and/or limited by guide features 432*a*, 432*b* and/or guide slots 433*a*, 433*b*.

Movable member 416 includes an elastic feature 434 located at or near the first end 420 and movable member 418 includes an elastic feature 436 located at or near the first end 422. The elastic features 434, 436 are configured to compress (e.g., deform) when a force is applied to movable members 416, 418, e.g., when a DIMM is inserted into slot 404 and to uncompress (i.e., relax) if the force is removed, e.g., if the DIMM is removed from the slot 404. When the elastic features 434, 436 are relaxed, their shapes may be generally circular. When the elastic features 434, 436 are compressed their shapes may be generally ellipsoidal. When the elastic features 434, 436 are relaxed, their respective movable members 416, 418 are configured to be disengaged from their respective stub members 412, 414.

The elastic features 434, 436 may be positioned in housing 402 relative to respective rigid features 444, 446. The rigid features 444, 446 are configured to ensure that the elastic features 434, 436 compress as respective movable members 416, 418 translate when a DIMM is inserted in slot 404. The elastic features 434, 436 may be sized and positioned to achieve a desired insertion force and/or a desired spacing between stub members 412, 414 and respective movable members 416, 418 when disengaged.

Movable members 416, 418 may further include elastic features 440, 442 at or near their respective second ends 424, 426. The elastic features 440, 442 are configured to be compressed by their respective stub members 412, 414 when the DIMM is inserted into slot 404 and the elastic features 440, 442 engage their respective stub members 412, 414. The elastic features 440, 442 are configured to uncompress if the DIMM is removed from the slot and the elastic features 440, 442 become disengaged from their respective stub members 412, 414. The elastic features 440, 442 are configured to facilitate engagement and/or electrical contact between movable members 416, 418 and their respective stub members 412, 414. For example, the elastic features 440, 442 may include and/or correspond to electrical contacts (i.e., contact regions) configured to electrically couple to respective stub members 412, 414.

In operation, when a DIMM is inserted into slot 404, the DIMM may first contact the elastic feature 436 of movable member 418 and may then contact the elastic feature 434 of movable member 416. As the DIMM continues to move into the slot 404, elastic members 434, 436 are configured to deform. Movable member 416 is configured to translate upward as elastic feature 434 deforms so that the second end 424 moves toward the top stub member 412 and movable member 418 is configured to translate downward as elastic feature 436 deforms so that the second end 426 moves toward the bottom stub member 414. Elastic features 434, 436 are configured to compress to cause their respective movable members to translate. As the DIMM moves further into the slot 404, movable members 416, 418 may translate further until elastic features 440, 442 contact respective stub members 412, 414 and similarly compress.

Figure 5A:
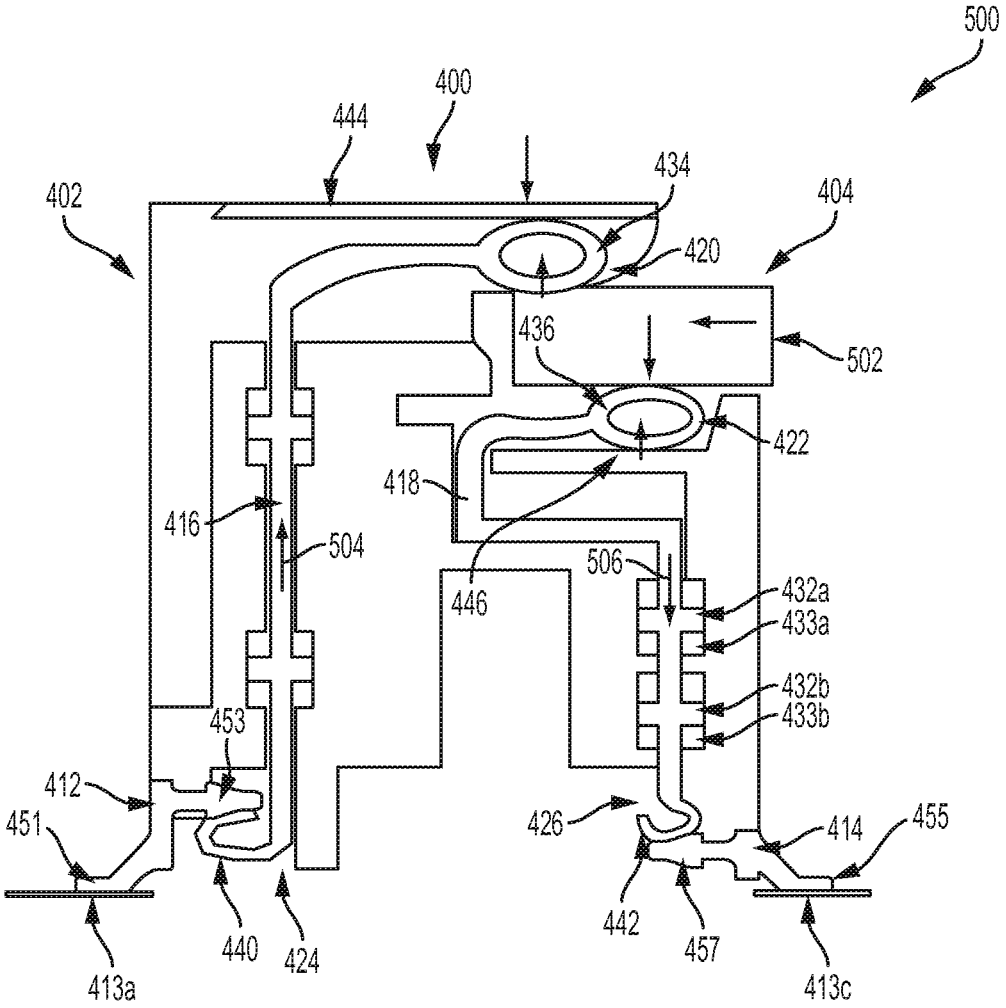
FIG. 5A illustrates one loaded example of the electrical connector of FIG. 4, consistent with one embodiment of the present disclosure.

FIG. 5A illustrates one loaded example 500 of the electrical connector 400 of FIG. 4, consistent with one embodiment of the present disclosure. Loaded example 500 includes electrical connector 400 and DIMM 502 inserted into the slot 404 of electrical connector 400. Top movable member 416 is engaged with top stub member 412 and bottom movable member 418 is engaged with bottom stub member 414. Top movable member 416 is engaged with the second portion 453 of top stub member 412 to create a conductive path and bottom movable member 418 is engaged with the second portion 457 of bottom stub member 414 to create a conductive path. In other words, since there is a printed circuit board, e.g., DIMM 502, inserted in slot 404, top stub member 412 and bottom stub member 414 are engaged with their respective movable members 416, 418 to form a conductive path of the electrical connector 400.

Elastic features 434, 436 are compressed between DIMM 502 and respective rigid features 444, 446. Arrows 504, 506 indicate direction of translation of movable members 416, 418, respectively, as DIMM 502 is inserted in slot 404. Thus, in this loaded example, a top conductive path is created between DIMM 502 and contact 508 and a bottom conductive path is created between DIMM 502 and contact 510. The top conductive path includes top movable member 416 and the first portion 451 and second portion 453 of top stub member 412. The bottom conductive path includes bottom movable member 418 and the first portion 455 and second portion 457 of bottom stub member 414.

Figure 5B:
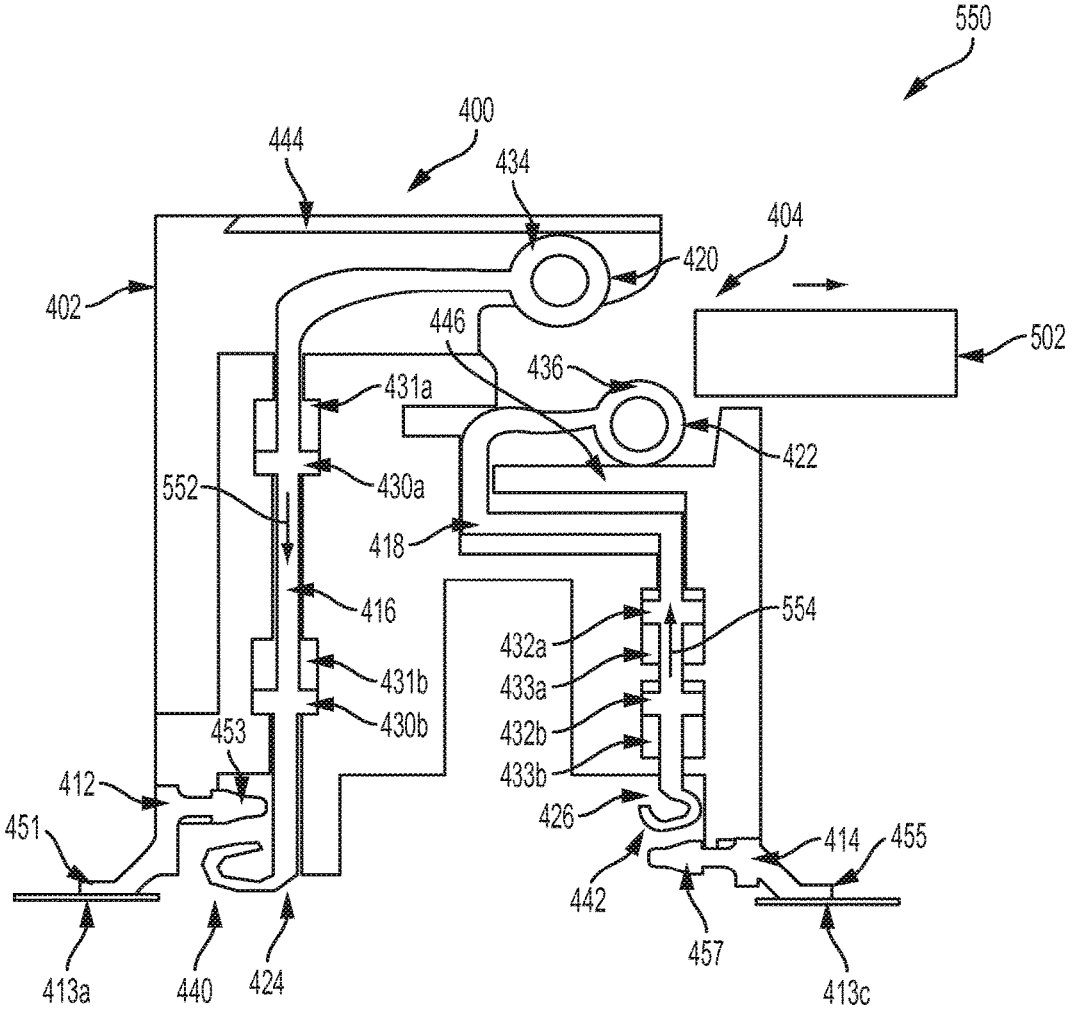
FIG. 5B illustrates an unloaded example of the electrical connector of FIG. 5A when the DIMM is removed from the slot, consistent with the present disclosure.

FIG. 5B illustrates an unloaded example 550 of the electrical connector of FIG. 5A when the DIMM is removed from the slot, consistent with the present disclosure. Unloaded example 550 includes electrical connector 400 and DIMM 502 after removal from the slot 404 of electrical connector 400. Top movable member 416 is disengaged from top stub member 412 and bottom movable member 418 is disengaged from bottom stub member 414. Elastic features 434, 436 are uncompressed. Arrows 552, 554 indicate direction of translation of movable members 416, 418, respectively, as DIMM 502 is removed from slot 404. Thus, in this unloaded example, top movable member 416 is not engaged with the second portion 453 of top stub member 412 and bottom movable member 418 is not engaged with the second portion 457 of bottom stub member 414. Thus, effects of reflections from top-row pin 403 and bottom-row pin 405 may be at least one of minimized and/or reduced when the DIMM 502 is removed from the slot 404.

Figure 6:
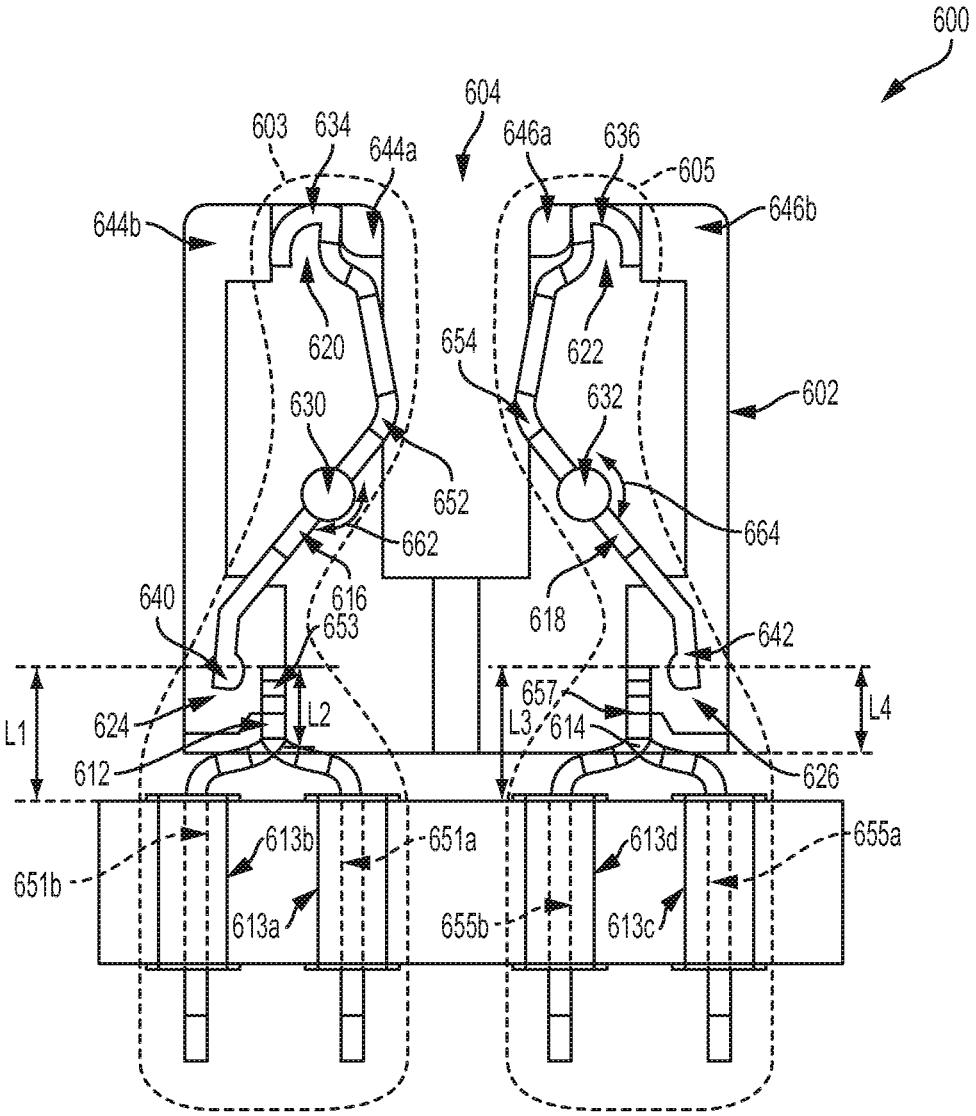
FIG. 6 illustrates a sectional view of another electrical connector consistent with one embodiment of the present disclosure.

FIG. 6 illustrates a sectional view of another electrical connector 600 consistent with one embodiment of the present disclosure. Electrical connector 600 is another example electrical connector that may correspond to electrical connectors 104*a*, 104*b* of FIG. 1. Electrical connector 600 is configured for through hole mounting to PCB 102. Electrical connector 600 includes a housing 602, a first (i.e., left) row pin 603 that includes a first (i.e., left) stub member 612 and a first (i.e., left) movable member 616 and a second (i.e., right) row pin 605 that includes a second (i.e., right) stub member 614 and a second (i.e., right) movable member 618. The housing 602 defines a slot 604 configured to receive a DIMM.

Left stub member 612 includes first portions 651*a*, 651*b* (collectively first portion 651) and a second portion 653 and right stub member 614 includes first portions 655*a*, 655*b* (collectively first portion 655) and a second portion 657. The first portions 651, 655 are configured to couple electrical connector 600 to a printed circuit board. For example, first portion 651 is configured to couple left stub member 612 to a plurality of electrical contacts, e.g., through-holes, 613*a*, 613*b*. In another example, first portion 655 is configured to couple right stub member 614 to a plurality of electrical contacts, e.g., through-holes, 613*c*, 613*d*. Electrical contacts 613*a*, 613*b* correspond to pad 113*a* and electrical contacts 613*c*, 613*d* correspond to pad 113*c* of printed circuit board 102 of FIG. 1.

Each stub member 612, 614 is only engaged with the respective movable member 616, 618 when a printed circuit board, e.g., a DIMM, is inserted into the slot 604. For example, left movable member 616 is not engaged with the second portion 653 of left stub member 612 and right movable member 618 is not engaged with the second portion 657 of right stub member 614. In other words, since there is not a DIMM inserted in slot 604, left stub member 612 and right stub member 614 are not engaged with their respective movable members 616, 618.

A length L1 of the left stub member 612 from left stub member tip to PCB surface is less than a length of the left-row pin 603. Similarly, a length L3 from right stub member tip to PCB surface of the right stub member 614 is less than a length of the right-row pin 605. Lengths L1, L2 of left stub member 612 and lengths L3, L4 of right stub member 614 are less than lengths of respective movable members 616, 618. Lengths of movable members 616, 618 may be any length sufficient to provide a conductive path between an inserted DIMM and respective stub members 612, 614. Lengths L1, L2, L3 and L4 are configured to reduce and/or minimize effects of reflections from unloaded electrical connectors, as described herein.

First movable member 616 includes a first end 620 and a second end 624. Second movable member 618 includes a first end 622 and a second end 626. The first movable member 616 and the second movable member 618 are operable to engage respective second portions 653, 657 of stub members 612, 614. First movable member 616 includes a first contact region 652 and second movable member 618 includes a second contact region 654. The contact regions 652, 654 may correspond to electrical contacts. The first contact region 652 and second contact region 654 are positioned generally opposed within the slot 604. The contact regions 652, 654 are configured to couple to corresponding electrical contacts on, for example, a DIMM inserted in slot 604. First movable member 616 is configured to engage the second portion 653 of first stub member 612 generally near the second end 624 and second movable member 618 is configured to engage the second portion 657 of second stub member 614 generally near the second end 626. The second ends 624, 626 may include and/or correspond to electrical contacts (i.e., contact regions) configured to electrically couple to respective second portions 653, 657 of stub members 612, 614.

Movable members 616, 618 are each configured to pivot, i.e., rotate in the directions of arrows 662, 664, about a respective pivot pin 630, 632. The pivot pins 630, 632 are located between the respective first ends 620, 622 and respective second ends 624, 626. For example, the pivot pins 630, 632 may be located between the contact regions 652, 654 and the respective second ends 624, 626.

Movable member 616 includes an elastic feature 634 located at or near the first end 620 and movable member 618 includes an elastic feature 636 located at or near the first end 622. The elastic features 634, 636 are configured to compress when a force is applied to the movable members 616, 618, e.g., when a DIMM is inserted into slot 604 and to uncompress (i.e., relax) if the force is removed, e.g., if the DIMM is removed from the slot 604. When the elastic features 634, 636 are relaxed, their respective movable members 616, 618 are configured to be disengaged from their respective stub members 612, 614. For example, the elastic features 634, 636 may include a spring, a flexible member (e.g., curved, generally circular, generally ellipsoidal), a circular coil structure, etc. The elastic features 634, 636 may be positioned in housing 602 relative to respective rigid features 644*a*, 644*b* and 646*a*, 646*b*. The rigid features 644*a*, 644*b*, 646*a*, 646*b* are configured to ensure that the elastic features 634, 636 compress as respective movable members 616, 618 rotate when a DIMM is inserted in slot 604. The elastic features 634, 636 may be sized and/or positioned to achieve a desired insertion force and/or a desired spacing between stub members 612, 614 and respective movable members when disengaged.

Movable members 616, 618 may further include elastic features 640, 642 at or near their respective second ends 624, 626. The elastic features 640, 642 are configured to be compressed by their respective stub members 612, 614 when the DIMM is inserted into slot 604 and the elastic features 640, 642 engage their respective stub members 612, 614. The elastic features 640, 642 are configured to uncompress if the DIMM is removed from the slot and the elastic features 640, 642 become disengaged from their respective stub members 612, 614. The elastic features 640, 642 are configured to facilitate engagement and/or electrical contact between movable members 616, 618 and their respective stub members 612, 614. For example, the elastic features 640, 642 may include and/or correspond to electrical contacts (i.e., contact regions) configured to electrically couple to respective stub members 612, 614.

In operation, when a DIMM is inserted into slot 604, the DIMM may contact the contact region 652 of movable member 616 and the contact region 654 of movable member 618. As the DIMM continues to move into the slot 604, movable member 616 is configured to rotate counter clockwise around the pivot 630 and movable member 618 is configured to rotate clockwise about pivot 632. Elastic features 634, 636 are configured to compress as their respective movable members rotate. As the DIMM moves further into the slot 604, movable members 616, 618 may rotate further until elastic features 640, 642 contact respective stub members 612, 614 and similarly compress.

Figure 7A:
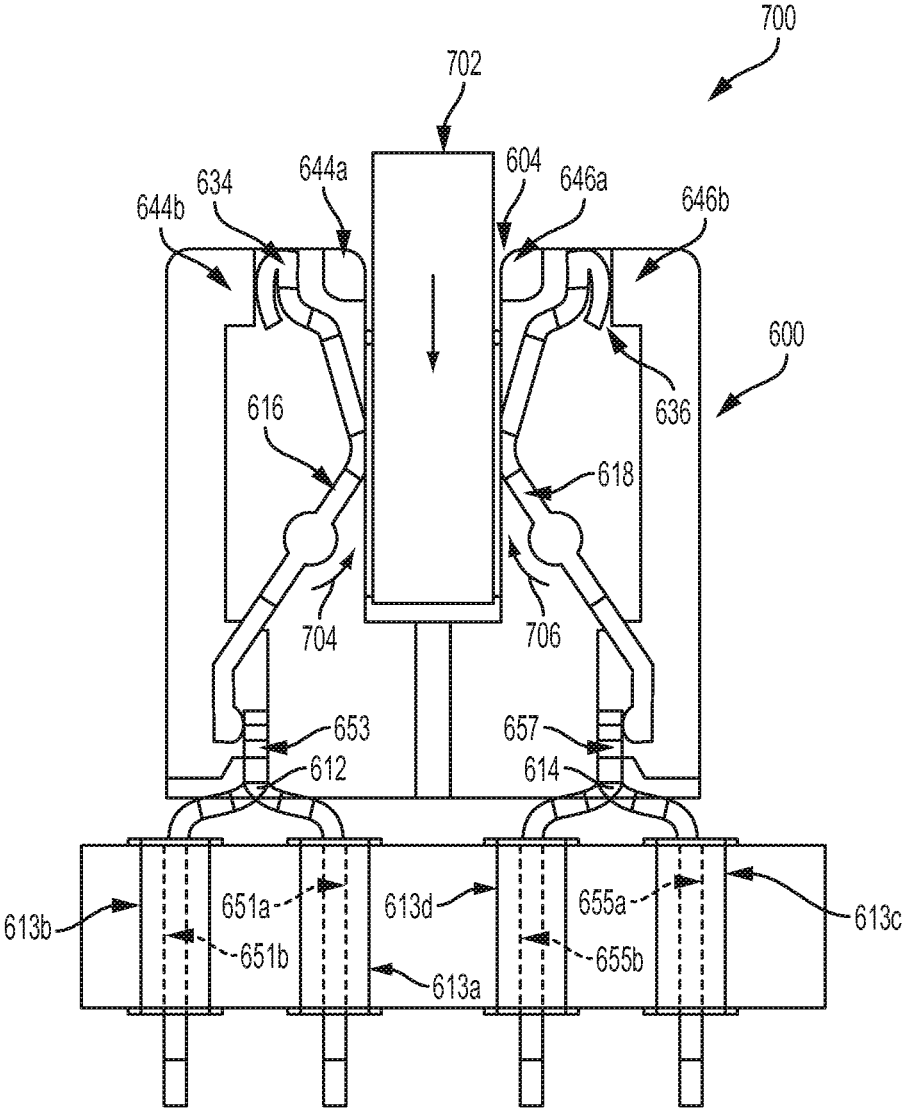
FIG. 7A illustrates one loaded example of the electrical connector of FIG. 6, consistent with one embodiment of the present disclosure.

FIG. 7A illustrates one loaded example 700 of the electrical connector 600 of FIG. 6, consistent with one embodiment of the present disclosure. Loaded example 700 includes electrical connector 600 and DIMM 702 inserted into the slot 604 of electrical connector 600. First movable member 616 is engaged with first stub member 612 and second movable member 618 is engaged with second stub member 614. First movable member 616 is engaged with the second portion 653 of first stub member 612 to create a conductive path and second movable member 618 is engaged with the second portion 657 of second stub member 614 to create a conductive path. In other words, since there is a printed circuit board, e.g., DIMM 702, inserted in slot 604, first stub member 612 and second stub member 614 are engaged with their respective movable members 616, 618 to form a conductive path of the electrical connector 600.

Elastic feature 634 is compressed against rigid feature 644*b*. Elastic feature 636 is compressed against rigid feature 646*b*. Arrows 704, 706 indicate direction of rotation of movable members 616, 618, respectively, as DIMM 702 is inserted in slot 604. Thus, in this loaded example, a first conductive path is created between DIMM 702 and vias 613*a*, 613*b* and a second conductive path is created between DIMM 702 and vias 613*c*, 613*d*. The first conductive path includes first movable member 616 and the first portions 651*a*, 651*b* and second portion 653 of first stub member 612. The second conductive path includes second movable member 618 and the first portions 655*a*, 655*b* and second portion 657 of second stub member 614.

Figure 7B:
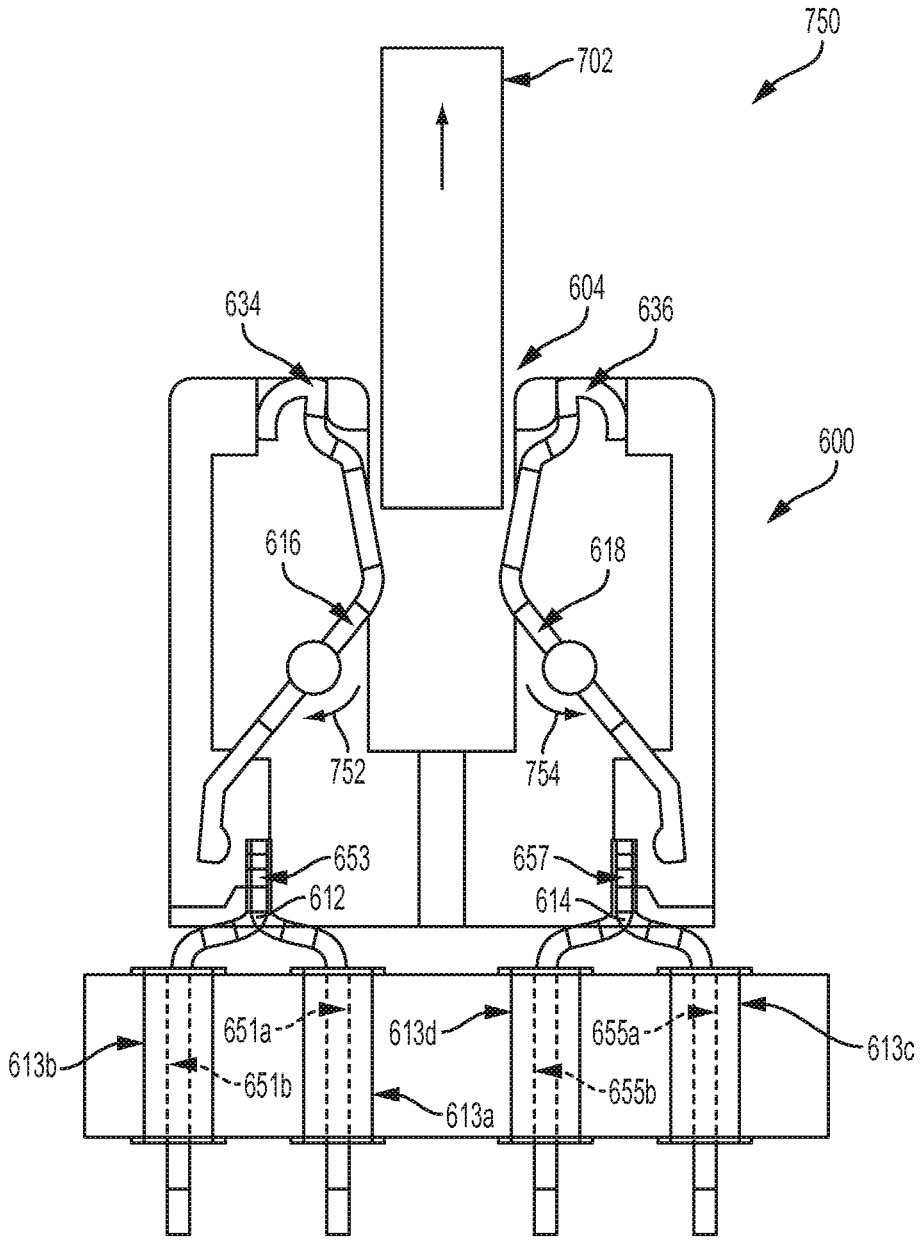
FIG. 7B illustrates an unloaded example of the electrical connector of FIG. 7A when the DIMM is removed from the slot, consistent with the present disclosure.

FIG. 7B illustrates an unloaded example 750 of the electrical connector of FIG. 7A when the DIMM is removed from the slot, consistent with the present disclosure. Unloaded example 750 includes electrical connector 600 and DIMM 702 after removal of DIMM from the slot 604 of electrical connector 600. First movable member 616 is disengaged from first stub member 612 and second movable member 618 is disengaged from second stub member 614. Elastic features 634, 636 may be uncompressed and/or less compressed than loaded example 700. Arrows 752, 754 indicate direction of rotation of movable members 616, 618, respectively, as DIMM 702 is removed from slot 604. Thus, in this unloaded example, first movable member 616 is not engaged with the second portion 653 of first stub member 612 and second movable member 618 is not engaged with the second portion 657 of second stub member 614. Thus, effects of reflections from first-row pin 603 and second-row pin 605 may be at least one of minimized and/or reduced when the DIMM 702 is removed from the slot 604. Thus, effects of reflections from first row pin 603 and second row pin 605 may be at least one of minimized and/or reduced.

Figure 8A:
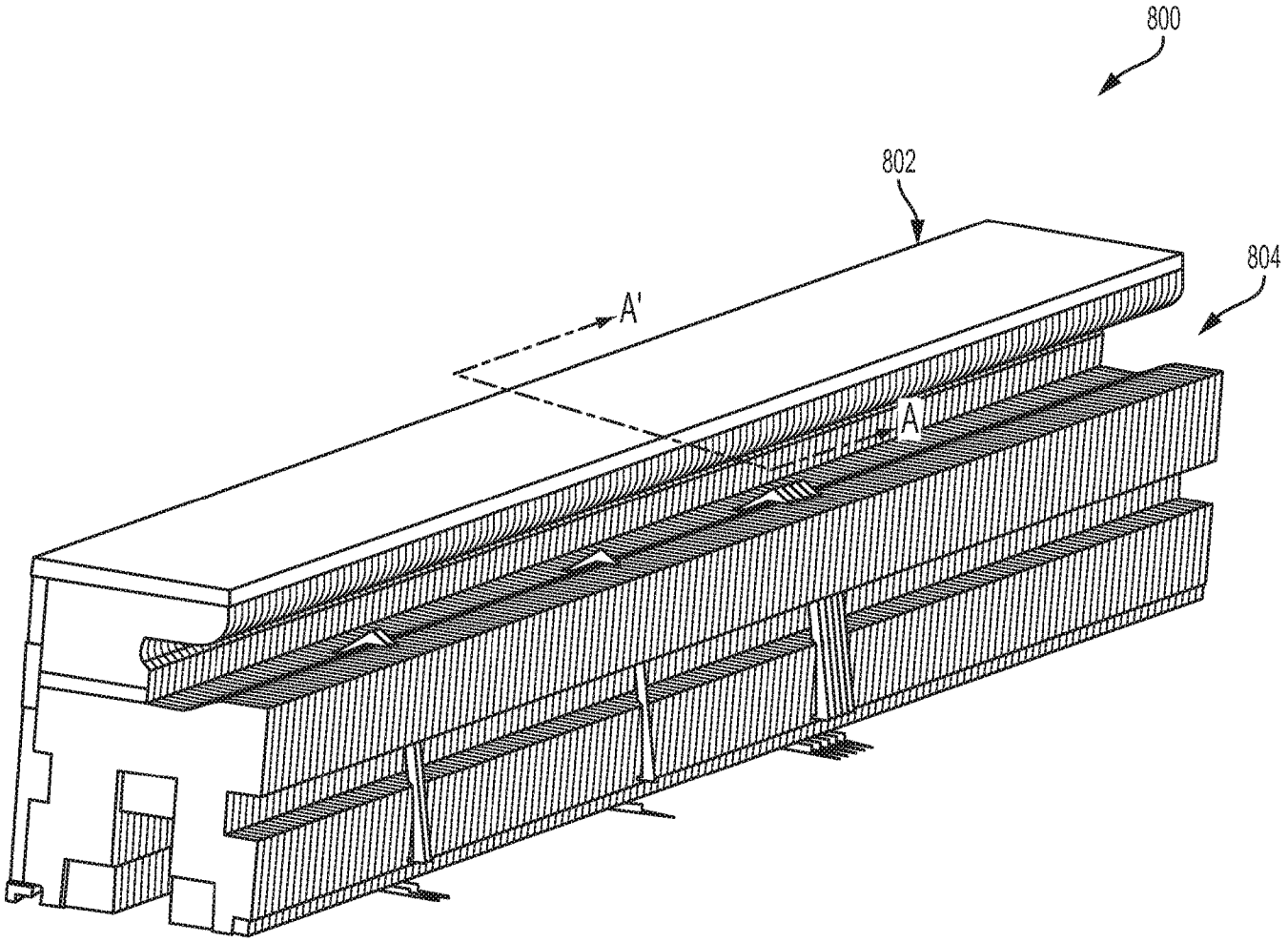
FIGS. 8A and 8B are sketches of example electrical connectors, consistent with various embodiments of the present disclosure.
Figure 8B:
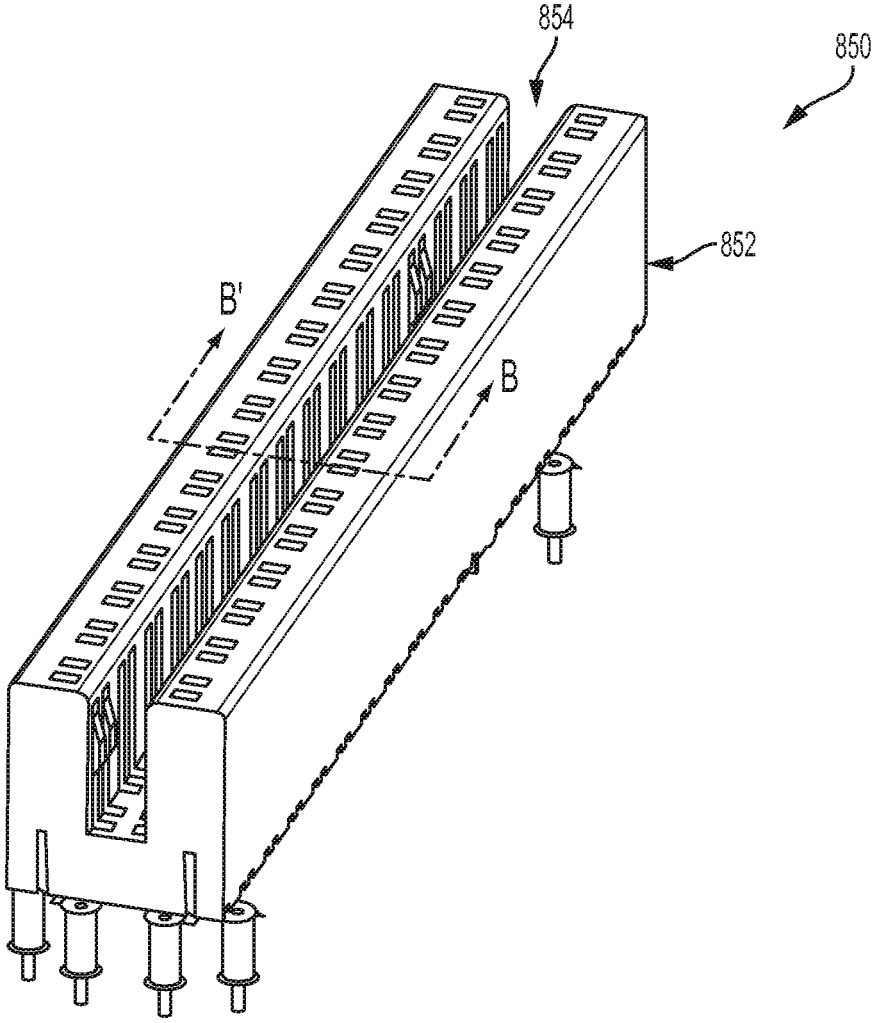

FIGS. 8A and 8B are sketches of example electrical connectors 800, 850, consistent with various embodiments of the present disclosure. FIGS. 8A and 8B are provided to illustrate orientation of the pins that each include a stub member and a movable member, as described herein. FIGS. 2 through 5B are sectional views from the perspective A-A' of FIG. 8A and FIGS. 6 through 7B are sectional views from the perspective B-B' of FIG. 8B. Example 800 is a surface mount configuration and includes a housing 802 and a slot 804. Example 850 is a through hole configuration and includes a housing 852 and a slot 854. A plurality of movable members, as described herein, may be positioned within a respective housing relative to each slot 804, 854. Each electrical connector may further include a plurality of stub members, as described herein.

Thus, an electrical connector may include a housing defining a slot and one or more electrical pins. Each electrical pin includes a stub member and a movable member. The stub member includes a first portion and a second portion. The first portion is configured to couple to a printed circuit board. The movable member is operable to engage the second portion to create a conductive path. The stub member is only engaged with the movable member when a printed circuit board, e.g., a DIMM, is inserted into the slot. A length of the stub member is configured to reduce and/or minimize effects of reflections when the electrical connector is unloaded. In other words, a length of the stub member is configured to reduce effects of reflections when the movable member and the stub member are not engaged. The stub member is configured to reduce an electrical length of a pin coupled to a PCB trace when the electrical connector is not loaded (i.e., is unloaded). Geometries of the stub member and/or movable member may vary. The movable member may be configured to rotate and/or translate in response to insertion or removal of a DIMM into or from a corresponding slot in an electrical connector. Movement of the movable member may be configured to engage or disengage the stub member. Effects of reflections may then be minimized when the stub member is disengaged.

Electrical connectors 104*a*, 104*b*, 200, 400, 600, 800 and 850 may comply and/or be compatible with one or more electrical connector specifications and/or standards. For example, electrical connectors 104*a*, 104*b*, 200, 400, 600, 800 and 850 may comply and/or be compatible with Joint Electron Device Engineering Council (JEDEC®) standard number JESD21-C, title: "Configurations for Solid State Memories", released January 2003, maintained by JEDEC® Solid State Memories committee JC-42 and/or later and/or related versions of this standard. In another example, electrical connectors 104*a*, 104*b*, 200, 400, 600, 800 and 850 may comply and/or be compatible with JEDEC® standard number JESD79-3F, title: "DDR3 SDRAM standard", released July 2012, maintained by JEDEC® Solid State Memories committee DRAM memories subcommittee JC-42.3 and/or later and/or related versions of this standard.

Thus, consistent with the teachings of the present disclosure, an electrical connector includes a housing defining a slot and one or more electrical pins. Each electrical pin includes a stub member and a movable member. The stub member includes a first portion and a second portion. The first portion is configured to couple to a printed circuit board. The movable member is operable to engage the second portion to create a conductive path. The stub member is only engaged with the movable member when a printed circuit board, e.g., a DIMM, is inserted into the slot. A length of the stub member is configured to reduce and/or minimize effects of reflections when the electrical connector is unloaded. In other words, a length of the stub member is configured to reduce effects of reflections when the movable member and the stub member are not engaged. The stub member is configured to reduce an electrical length of a pin coupled to a PCB trace when the electrical connector is not loaded (i.e., is unloaded). A length of the stub member is configured to reduce and/or minimize effects of reflections when the electrical connector is unloaded. The stub member is configured to reduce an electrical length of a pin coupled to a PCB trace when the electrical connector is not loaded (i.e., is unloaded).

EXAMPLES

Examples of the present disclosure include subject material such as a method, means for performing acts of the method, a device, or of an apparatus or system related to an electrical connector, as discussed below.

Example 1 According to this example, there is provided an apparatus. The apparatus includes a stub member including a first portion and a second portion. The first portion is to couple to a first printed circuit board. The apparatus further includes a movable member operable to engage the second portion of the stub member to create a conductive path, wherein the stub member is only engaged with the movable member when a second printed circuit board is inserted into the slot.

Example 2 This example includes the elements of example 1, wherein the movable member is further operable to disengage from the stub member.

Example 3 This example includes the elements of example 1, wherein the movable member includes a first elastic feature, the first elastic feature to allow the movable member to engage the stub member when a force is applied to the movable member and to cause the movable member to disengage from the stub member when the force is removed.

Example 4 This example includes the elements of example 1, wherein the movable member includes a second elastic feature, the second elastic feature to compress when the movable member engages the stub member.

Example 5 This example includes the elements according to any one of examples 1 through 4, wherein the movable member is operable to translate to engage the stub member.

Example 6 This example includes the elements according to any one of examples 1 through 4, wherein the movable member is operable to rotate to engage the stub member.

Example 7 This example includes the elements according to any one of examples 1 through 4, wherein a length of the stub member is to reduce effects of reflections when the movable member and the stub member are not engaged.

Example 8 This example includes the elements according to any one of examples 1 through 4, wherein the stub member is to connect to a through hole pin.

Example 9 This example includes the elements according to any one of examples 1 through 4, wherein a length of the stub member is less than a length of the movable member.

Example 10 This example includes the elements according to any one of examples 1 through 4, wherein the stub member is to connect to a surface mount pad.

Example 11 This example includes the elements according to any one of examples 1 through 4, wherein a shape of the stub member is configured to facilitate placing and securely fixing the stub member in a housing.

Example 12 This example includes the elements according to any one of examples 1 through 4, wherein a shape of the stub member is configured provide at least a minimum surface area for electrical contact with the movable member when engaged.

Example 13 This example includes the elements according to any one of examples 1 through 4, wherein at least one of a thickness of the stub member and/or a thickness of the movable member is related to a pin to pin pitch.

Example 14 This example includes the elements of example 13, wherein at least one of a thickness of the stub member and/or a thickness of the movable member is in the range of 125 micrometers (μm) to 250 μm.

Example 15 This example includes the elements according to any one of examples 1 through 4, wherein the stub member has a first length of 1.5 millimeters (mm) plus or minus a tolerance.

Example 16 This example includes the elements according to any one of examples 1 through 4, wherein the stub member has a second length of 2.5 millimeters (mm) plus or minus a tolerance.

Example 17 This example includes the elements according to any one of examples 1 through 4, wherein at least one of the stub member and/or the movable member includes a copper alloy.

Example 18 This example includes the elements according to any one of examples 1 through 4, wherein a contact surface of at least one of the stub member and/or the movable member is plated with gold.

Example 19 This example includes the elements of example 3, wherein the first elastic feature is selected from the group including a spring, a curved flexible member, a generally circular flexible member, a generally ellipsoidal flexible member and a circular coil structure.

Example 20 This example includes the elements of example 3, wherein the first elastic feature is to compress or extend when the force is applied to the movable member and to relax when the force is removed.

Example 21 This example includes the elements of example 3, wherein the first elastic feature is to deform when the force is applied to the movable member and to return to an original shape when the force is removed.

Example 22 This example includes the elements according to any one of examples 19 through 21, wherein a shape of the first elastic feature is ellipsoidal when the force is applied to the movable member and circular when the force is removed.

Example 23 This example includes the elements according to any one of examples 1 through 4, wherein the movable member is to rotate about a pivot point to engage the stub member.

Example 24 This example includes the elements of example 23, wherein the movable member is to rotate through an angle of less than ten degrees.

Example 25 This example includes the elements of example 23, wherein the movable member is to rotate ±6 degrees.

Example 26 This example includes the elements according to any one of examples 1 through 4, wherein the movable member includes a pivot feature to facilitate rotation about a pivot point to engage the stub member.

Example 27 This example includes the elements of example 5, wherein the movable member includes a guide feature, the guide features to move in a guide slot.

Example 28 This example includes the elements of example 27, wherein at least one of the guide slot and the guide feature are to guide translation motion of the movable member.

Example 29 This example includes the elements of example 3, wherein the first elastic feature is at least one of sized and/or positioned to achieve at least one of a desired insertion force and/or a desired spacing between the stub member and the movable member when disengaged.

Example 30 This example includes the elements according to any one of examples 1 through 4, wherein the movable member includes a first contact region and a second contact region.

Example 31 This example includes the elements of example 30, wherein the first contact region is to contact a corresponding electrical contact of a DIMM and the second contact region is to contact the stub member when a force is applied to the movable member.

Example 32 This example includes the elements of example 30, wherein the first contact region is positioned at or near a first end of the movable member and the second contact region is positioned at or near a second end of the movable member.

Example 33 According to this example, there is provided a method. The method includes coupling, by a first portion of a stub member, to a first printed circuit board. The method further includes engaging, by a movable member, a second portion of the stub member to create a conductive path, wherein the stub member is only engaged with the movable member when a second printed circuit board is inserted into a slot in an electrical connector that includes the stub member in the movable member.

Example 34 This example includes the elements of example 33, further including disengaging, by the movable member, from the stub member.

Example 35 This example includes the elements of example 33, wherein the movable member includes a first elastic feature, the first elastic feature to allow the movable member to engage the stub member when a force is applied to the movable member and to cause the movable member to disengage from the stub member when the force is removed.

Example 36 This example includes the elements of example 33, wherein the movable member includes a second elastic feature, the second elastic feature to compress when the movable member engages the stub member.

Example 37 This example includes the elements of example 33, wherein the engaging includes translating.

Example 38 This example includes the elements of example 33, wherein the engaging includes rotating.

Example 39 This example includes the elements of example 33, wherein a length of the stub member is to reduce effects of reflections when the movable member and the stub member are not engaged.

Example 40 This example includes the elements of example 33, engaging, by the movable member, the stub member when a dual inline memory module (DIMM) is inserted in a slot.

Example 41 This example includes the elements of example 33, wherein the stub member is to connect to a through hole pin.

Example 42 This example includes the elements of example 33, wherein the stub member is to connect to a surface mount pad.

Example 43 This example includes the elements of example 33, wherein the stub member has a first length of 1.5 millimeters (mm) plus or minus a tolerance, the first length measured from a tip of the stub member to a bottom surface of a housing.

Example 44 This example includes the elements of example 33, wherein at least one of the stub member and/or the movable member includes a copper alloy.

Example 45 This example includes the elements of example 33, wherein a contact surface of at least one of the stub member and/or the movable member is plated with gold.

Example 46 This example includes the elements of example 33, wherein at least one of a thickness of the stub member and/or a thickness of the movable member is in the range of 125 micrometers (μm) to 250 μm.

Example 47 This example includes the elements of example 35, wherein the first elastic feature is to compress or extend when a force is applied to the movable member and to relax when the force is removed.

Example 48 This example includes the elements of example 35, wherein the first elastic feature is to deform when a force is applied to the movable member and to return to an original shape when the force is removed.

Example 49 This example includes the elements of example 48, wherein a shape of the first elastic feature is ellipsoidal when the force is applied to the movable member and circular when the force is removed.

Example 50 This example includes the elements of example 35, wherein the first elastic feature is to compress or extend when a DIMM (dual inline memory module) is inserted in a slot and to relax when a DIMM is removed.

Example 51 This example includes the elements of example 35, wherein the first elastic feature is to deform when a DIMM is inserted in a slot and to return to an original shape when the DIMM is removed.

Example 52 This example includes the elements of example 51, wherein a shape of the first elastic feature is ellipsoidal when the DIMM is inserted in the slot and circular when the DIMM is removed.

Example 53 This example includes the elements of example 33, including rotating, by the movable member, about a pivot point to engage the stub member.

Example 54 This example includes the elements of example 53, wherein the movable member is to rotate through an angle of less than ten degrees.

Example 55 This example includes the elements of example 53, wherein the movable member is to rotate ±6 degrees.

Example 56 This example includes the elements of example 33, including rotating, by the movable member, about a pivot pin to engage the stub member.

Example 57 This example includes the elements of example 33, wherein the stub member includes a first end and a second end, the movable member includes a first end and a second end and the first ends are positioned generally opposed within a slot.

Example 58 This example includes the elements of example 37, wherein the movable member includes a guide feature, further including moving, by the guide feature, in a guide slot.

Example 59 This example includes the elements of example 58, wherein the guide slot and the guide feature are to guide translation motion of the movable member.

Example 60 This example includes the elements of example 33, wherein the movable member includes a first contact region and a second contact region.

Example 61 This example includes the elements of example 60, including contacting, by the first contact region, a corresponding electrical contact of a DIMM and contacting, by the second contact region, the stub member when a force is applied to the movable member.

Example 62 This example includes the elements of example 60, wherein the first contact region is positioned at or near a first end of the movable member and the second contact region is positioned at or near a second end of the movable member.

Example 63 According to this example, there is provided an electrical connector. The electrical connector includes a housing defining a slot; and a pin. The pin includes a stub member including a first portion and a second portion, the first portion to couple to a first printed circuit board. The pin further includes a movable member operable to engage the second portion of the stub member to create a conductive path, wherein the stub member is only engaged with the movable member when a second printed circuit board is inserted into the slot.

Example 64 This example includes the elements of example 63, wherein the movable member is further operable to disengage from the stub member.

Example 65 This example includes the elements of example 63, wherein the movable member includes a first elastic feature, the first elastic feature to allow the movable member to engage the stub member when the second printed circuit board is inserted in the slot and the first elastic feature to cause the movable member to disengage from the stub member if the second printed circuit board is removed.

Example 66 This example includes the elements of example 63, wherein the movable member includes a second elastic feature, the second elastic feature to compress when the movable member engages the stub member.

Example 67 This example includes the elements according to any one of examples 63 through 66, wherein the movable member is operable to translate to engage the stub member.

Example 68 This example includes the elements according to any one of examples 63 through 66, wherein the movable member is operable to rotate to engage the stub member.

Example 69 This example includes the elements according to any one of examples 63 through 66, wherein a length of the stub member is to reduce effects of reflections when the movable member and the stub member are not engaged.

Example 70 This example includes the elements according to any one of examples 63, 64 and 66, wherein the movable member includes a first elastic feature, the first elastic feature to allow the movable member to engage the stub member when a force is applied to the movable member and to cause the movable member to disengage from the stub member when the force is removed.

Example 71 This example includes the elements according to any one of examples 63 through 66, wherein the housing includes a plurality of pins.

Example 72 This example includes the elements according to any one of examples 63 through 66, wherein the stub member is to connect to a through hole pin.

Example 73 This example includes the elements according to any one of examples 63 through 66, wherein a length of the stub member is less than a length of the movable member.

Example 74 This example includes the elements according to any one of examples 63 through 66, wherein the stub member is to connect to a surface mount pad.

Example 75 This example includes the elements according to any one of examples 63 through 66, wherein the stub member has a first length of 1.5 millimeters (mm) plus or minus a tolerance, the first length measured from a tip of the stub member to a bottom surface of the housing.

Example 76 This example includes the elements according to any one of examples 63 through 66, wherein the stub member has a second length of 2.5 millimeters (mm) plus or minus a tolerance, the second length measured from a tip of the stub member to a top surface of a printed circuit board to receive the electrical connector.

Example 77 This example includes the elements according to any one of examples 63 through 66, wherein at least one of the stub member and/or the movable member includes a copper alloy.

Example 78 This example includes the elements according to any one of examples 63 through 66, wherein a contact surface of at least one of the stub member and/or the movable member is plated with gold.

Example 79 This example includes the elements according to any one of examples 63 through 66, wherein a shape of the stub member is configured to facilitate placing and securely fixing the stub member in the housing.

Example 80 This example includes the elements according to any one of examples 63 through 66, wherein a shape of the stub member is configured provide at least a minimum surface area for electrical contact with the movable member when engaged.

Example 81 This example includes the elements according to any one of examples 63 through 66, wherein at least one of a thickness of the stub member and/or a thickness of the movable member is related to a pin to pin pitch.

Example 82 This example includes the elements of example 81, wherein at least one of a thickness of the stub member and/or a thickness of the movable member is in the range of 125 micrometers (μm) to 250 μm.

Example 83 This example includes the elements of example 65 or 70, wherein the first elastic feature is selected from the group including a spring, a curved flexible member, a generally circular flexible member, a generally ellipsoidal flexible member and a circular coil structure.

Example 84 This example includes the elements of example 65 or 70, wherein the first elastic feature is to compress or extend when a force is applied to the movable member and to relax when the force is removed.

Example 85 This example includes the elements of example 65 or 70, wherein the first elastic feature is to deform when a force is applied to the movable member and to return to an original shape when the force is removed.

Example 86 This example includes the elements of example 65 or 70, wherein a shape of the first elastic feature is ellipsoidal when the force is applied to the movable member and circular when the force is removed.

Example 87 This example includes the elements of example 65, wherein the first elastic feature is to compress or extend when the second printed circuit board is inserted in the slot and to relax when the second printed circuit board is removed.

Example 88 This example includes the elements of example 65, wherein the first elastic feature is to deform when the second printed circuit board is inserted in the slot and to return to an original shape when the second printed circuit board is removed.

Example 89 This example includes the elements according to any one of examples 87 through 88, wherein a shape of the first elastic feature is ellipsoidal when the second printed circuit board is inserted in the slot and circular when the second printed circuit board is removed.

Example 90 This example includes the elements according to any one of examples 63 through 66, wherein the movable member is to rotate about a pivot point to engage the stub member.

Example 91 This example includes the elements of example 90, wherein the movable member is to rotate through an angle of less than ten degrees.

Example 92 This example includes the elements of example 90, wherein the movable member is to rotate ±6 degrees.

Example 93 This example includes the elements according to any one of examples 63 through 66, wherein the movable member includes a pivot feature to facilitate rotation about a pivot point to engage the stub member.

Example 94 This example includes the elements of example 93, wherein the housing defines a cavity to accommodate the pivot feature.

Example 95 This example includes the elements according to any one of examples 63 through 66, further including a pivot pin, wherein the movable member is to rotate about the pivot pin to engage the stub member.

Example 96 This example includes the elements of example 95, wherein the housing defines a cavity to accommodate the pivot pin.

Example 97 This example includes the elements according to any one of examples 63 through 66, wherein the stub member includes a first end and a second end, the movable member includes a first end and a second end and the first ends are positioned generally opposed within the slot.

Example 98 This example includes the elements of example 67, wherein the housing defines a guide slot and the movable member includes a guide feature, the guide feature to move in the guide slot.

Example 99 This example includes the elements of example 98, wherein the guide slot and the guide feature are to guide translation motion of the movable member.

Example 100 This example includes the elements of example 65 or 70, wherein the housing includes a rigid feature, the first elastic feature positioned relative to the rigid feature.

Example 101 This example includes the elements of example 100, wherein the rigid feature is to ensure the first elastic feature deforms when the movable member engages the stub member.

Example 102 This example includes the elements of example 65 or 70, wherein the first elastic feature is at least one of sized and/or positioned to achieve at least one of a desired insertion force and/or a desired spacing between the stub member and the movable member when disengaged.

Example 103 This example includes the elements according to any one of examples 63 through 66, wherein the movable member includes a first contact region and a second contact region.

Example 104 This example includes the elements of example 103, wherein the first contact region is to contact a corresponding electrical contact of a DIMM and the second contact region is to contact the stub member when a force is applied to the movable member.

Example 105 This example includes the elements of example 103, wherein the first contact region is positioned at or near a first end of the movable member and the second contact region is positioned at or near a second end of the movable member.

Example 106 This example includes the elements according to any one of examples 63 through 66, and further includes a plurality of top-row pins. Each top-row pin includes a top stub member including a first portion and a second portion, the first portion to couple to a first printed circuit board; and a top movable member operable to engage the second portion of the top stub member to create a conductive path, wherein the top stub member is only engaged with the top movable member when a second printed circuit board is inserted into the slot.

Example 107 This example includes the elements of example 106, and further includes a plurality of bottom-row pins. Each bottom-row pin includes a bottom stub member including a first portion and a second portion, the first portion to couple to a first printed circuit board; and a bottom movable member operable to engage the second portion of the bottom stub member to create a conductive path, wherein the bottom stub member is only engaged with the bottom movable member when a second printed circuit board is inserted into the slot.

Example 108 This example includes the elements according to any one of examples 63 through 66, and further includes a plurality of left-row pins. Each left-row pin includes a left stub member including a first portion and a second portion, the first portion to couple to a first printed circuit board; and a left movable member operable to engage the second portion of the left stub member to create a conductive path, wherein the left stub member is only engaged with the left movable member when a second printed circuit board is inserted into the slot.

Example 109 This example includes the elements of example 108, and further includes a plurality of right-row pins. Each right-row pin includes a right stub member including a first portion and a second portion, the first portion to couple to a first printed circuit board; and a right movable member operable to engage the second portion of the right stub member to create a conductive path, wherein the right stub member is only engaged with the right movable member when a second printed circuit board is inserted into the slot.

Example 110 This example includes the elements according to any one of examples 63 through 66, wherein the electrical connector at least one of complies and/or is compatible with Joint Electron Device Engineering Council (JEDEC®) standard number JESD21-C, title: "Configurations for Solid State Memories", released January 2003, maintained by JEDEC® Solid State Memories committee JC-42 and/or later and/or related versions of this standard.

Example 111 This example includes the elements according to any one of examples 63 through 66, wherein the electrical connector at least one of complies and/or is compatible with Joint Electron Device Engineering Council (JEDEC®) standard number JESD79-3F, title: "DDR3 SDRAM standard", released July 2012, maintained by JEDEC® Solid State Memories committee DRAM memories subcommittee JC-42.3 and/or later and/or related versions of this standard.

Example 112 According to this example, there is provided an electrical connector. The electrical connector includes a housing defining a slot; and a pin. The pin includes a stub member including a first portion and a second portion, the first portion to couple to a first printed circuit board; and movable means operable to engage the second portion of the stub member to create a conductive path, wherein the stub member is only engaged with the movable means when a second printed circuit board is inserted into the slot.

Example 113 This example includes the elements of example 112, wherein the movable means is further operable to disengage from the stub member.

Example 114 This example includes the elements of example 112, wherein the movable means includes a first elastic feature, the first elastic feature to allow the movable means to engage the stub member when the second printed circuit board is inserted in the slot and the first elastic feature to cause the movable means to disengage from the stub member if the second printed circuit board is removed from the slot.

Example 115 This example includes the elements of example 112, wherein the movable means includes a second elastic feature, the second elastic feature to compress when the movable member engages the stub member.

Example 116 This example includes the elements according to any one of examples 112 through 115, wherein the movable means is operable to translate to engage the stub member.

Example 117 This example includes the elements according to any one of examples 112 through 115, wherein the movable means is operable to rotate to engage the stub member.

Example 118 This example includes the elements according to any one of examples 112 through 115, wherein the second printed circuit board is a dual inline memory module (DIMM).

Example 119 According to this example, there is provided a system. The system includes a first printed circuit board; and a first electrical connector coupled to the first printed circuit board. The first electrical connector includes a housing defining a slot, and a pin. The pin includes a stub member including a first portion and a second portion, the first portion coupled to the first printed circuit board. The pin further includes a movable member operable to engage the second portion of the stub member to create a conductive path, wherein the stub member is only engaged with the movable member when a second printed circuit board is inserted into the slot.

Example 120 This example includes the elements of example 119, wherein the movable member is further operable to disengage from the stub member.

Example 121 This example includes the elements of example 119, wherein the movable member includes a first elastic feature, the first elastic feature to allow the movable member to engage the stub member when the second printed circuit board is inserted in the slot and the first elastic feature to cause the movable member to disengage from the stub member if the second printed circuit board is removed from the slot.

Example 122 This example includes the elements of example 119, wherein the movable member includes a second elastic feature, the second elastic feature to compress when the movable member engages the stub member.

Example 123 The system of according to any one of claims 119 through 122, wherein the movable member is operable to translate to engage the stub member.

Example 124 The system of according to any one of claims 119 through 122, wherein the movable member is operable to rotate to engage the stub member.

Example 125 The system of according to any one of claims 119 through 122, wherein the second printed circuit board is a dual inline memory module (DIMM).

Example 126 The system of according to any one of claims 119 through 122, further including a second electrical connector.

Example 127 This example includes the elements of example 126, wherein the first electrical connector is coupled to a first surface of the first printed circuit board and the second electrical connector is coupled to an opposing second surface of the first printed circuit board.

Example 128 This example includes the elements of example 126, further including an integrated circuit module coupled to the first printed circuit board, the integrated circuit module further coupled to the second printed circuit board when the second printed circuit board is inserted in the slot.

Example 129 This example includes the elements of example 128, wherein the integrated circuit module is a processor.

Example 130 This example includes the elements according to any one of examples 119 through 122, wherein a length of the stub member is to reduce effects of reflections when the movable member and the stub member are not engaged.

Example 131 This example includes the elements according to any one of examples 119, 120 and 122, wherein the movable member includes a first elastic feature, the first elastic feature to allow the movable member to engage the stub member when a force is applied to the movable member and to cause the movable member to disengage from the stub member when the force is removed.

Example 132 This example includes the elements according to any one of examples 119 through 122, wherein the housing includes a plurality of pins.

Example 133 This example includes the elements according to any one of examples 119 through 122, wherein the stub member is to connect to a through hole pin.

Example 134 This example includes the elements according to any one of examples 119 through 122, wherein a length of the stub member is less than a length of the movable member.

Example 135 This example includes the elements according to any one of examples 119 through 122, wherein the stub member is to connect to a surface mount pad.

Example 136 This example includes the elements according to any one of examples 119 through 122, wherein the stub member has a first length of 1.5 millimeters (mm) plus or minus a tolerance, the first length measured from a tip of the stub member to a bottom surface of the housing.

Example 137 This example includes the elements according to any one of examples 119 through 122, wherein the stub member has a second length of 2.5 millimeters (mm) plus or minus a tolerance, the second length measured from a tip of the stub member to a top surface of a printed circuit board to receive the electrical connector.

Example 138 This example includes the elements according to any one of examples 119 through 122, wherein at least one of the stub member and/or the movable member includes a copper alloy.

Example 139 This example includes the elements according to any one of examples 119 through 122, wherein a contact surface of at least one of the stub member and/or the movable member is plated with gold.

Example 140 This example includes the elements according to any one of examples 119 through 122, wherein a shape of the stub member is configured to facilitate placing and securely fixing the stub member in the housing.

Example 141 This example includes the elements according to any one of examples 119 through 122, wherein a shape of the stub member is configured provide at least a minimum surface area for electrical contact with the movable member when engaged.

Example 142 This example includes the elements according to any one of examples 119 through 122, wherein at least one of a thickness of the stub member and/or a thickness of the movable member is related to a pin to pin pitch.

Example 143 This example includes the elements of example 142, wherein at least one of a thickness of the stub member and/or a thickness of the movable member is in the range of 125 micrometers (μm) to 250 μm.

Example 144 This example includes the elements of example 121 or 131, wherein the first elastic feature is selected from the group including a spring, a curved flexible member, a generally circular flexible member, a generally ellipsoidal flexible member and a circular coil structure.

Example 145 This example includes the elements of example 121 or 131, wherein the first elastic feature is to compress or extend when a force is applied to the movable member and to relax when the force is removed.

Example 146 This example includes the elements of example 121 or 131, wherein the first elastic feature is to deform when a force is applied to the movable member and to return to an original shape when the force is removed.

Example 147 This example includes the elements of example 121 or 131, wherein a shape of the first elastic feature is ellipsoidal when the force is applied to the movable member and circular when the force is removed.

Example 148 This example includes the elements of example 121, wherein the first elastic feature is to compress or extend when the second printed circuit board is inserted in the slot and to relax when the second printed circuit board is removed.

Example 149 This example includes the elements of example 121, wherein the first elastic feature is to deform when the second printed circuit board is inserted in the slot and to return to an original shape when the second printed circuit board is removed.

Example 150 This example includes the elements according to any one of examples 148 through 149, wherein a shape of the first elastic feature is ellipsoidal when the second printed circuit board is inserted in the slot and circular when the second printed circuit board is removed.

Example 151 This example includes the elements according to any one of examples 119 through 122, wherein the movable member is to rotate about a pivot point to engage the stub member.

Example 152 This example includes the elements of example 151, wherein the movable member is to rotate through an angle of less than ten degrees.

Example 153 This example includes the elements of example 151, wherein the movable member is to rotate ±6 degrees.

Example 154 This example includes the elements according to any one of examples 119 through 122, wherein the movable member includes a pivot feature to facilitate rotation about a pivot point to engage the stub member.

Example 155 This example includes the elements of example 154, wherein the housing defines a cavity to accommodate the pivot feature.

Example 156 This example includes the elements according to any one of examples 119 through 122, further including a pivot pin, wherein the movable member is to rotate about the pivot pin to engage the stub member.

Example 157 This example includes the elements of example 156, wherein the housing defines a cavity to accommodate the pivot pin.

Example 158 This example includes the elements according to any one of examples 119 through 122, wherein the stub member includes a first end and a second end, the movable member includes a first end and a second end and the first ends are positioned generally opposed within the slot.

Example 159 This example includes the elements of example 123, wherein the housing defines a guide slot and the movable member includes a guide feature, the guide feature to move in the guide slot.

Example 160 This example includes the elements of example 159, wherein the guide slot and the guide feature are to guide translation motion of the movable member.

Example 161 This example includes the elements of example 121 or 131, wherein the housing includes a rigid feature, the first elastic feature positioned relative to the rigid feature.

Example 162 This example includes the elements of example 161, wherein the rigid feature is to ensure the first elastic feature deforms when the movable member engages the stub member.

Example 163 This example includes the elements of example 121 or 131, wherein the first elastic feature is at least one of sized and/or positioned to achieve at least one of a desired insertion force and/or a desired spacing between the stub member and the movable member when disengaged.

Example 164 This example includes the elements according to any one of examples 119 through 122, wherein the movable member includes a first contact region and a second contact region.

Example 165 This example includes the elements of example 164, wherein the first contact region is to contact a corresponding electrical contact of the second printed circuit board and the second contact region is to contact the stub member when a force is applied to the movable member.

Example 166 This example includes the elements of example 164, wherein the first contact region is positioned at or near a first end of the movable member and the second contact region is positioned at or near a second end of the movable member.

Example 167 This example includes the elements according to any one of examples 119 through 122, wherein the first electrical connector includes a plurality of top-row pins. Each top-row pin includes a top stub member including a first portion and a second portion, the first portion to couple to a first printed circuit board; and a top movable member operable to engage the second portion of the top stub member to create a conductive path, wherein the top stub member is only engaged with the top movable member when a second printed circuit board is inserted into the slot.

Example 168 This example includes the elements of example 167, wherein the first electrical connector includes a plurality of bottom-row pins. Each bottom-row pin includes a bottom stub member including a first portion and a second portion, the first portion to couple to a first printed circuit board; and a bottom movable member operable to engage the second portion of the bottom stub member to create a conductive path, wherein the bottom stub member is only engaged with the bottom movable member when a second printed circuit board is inserted into the slot.

Example 169 This example includes the elements according to any one of examples 119 through 122, wherein the first electrical connector includes a plurality of left-row pins. Each left-row pin includes a left stub member including a first portion and a second portion, the first portion to couple to a first printed circuit board; and a left movable member operable to engage the second portion of the left stub member to create a conductive path, wherein the left stub member is only engaged with the left movable member when a second printed circuit board is inserted into the slot.

Example 170 This example includes the elements of example 169, wherein the first electrical connector includes a plurality of right-row pins. Each right-row pin includes a right stub member including a first portion and a second portion, the first portion to couple to a first printed circuit board; and a right movable member operable to engage the second portion of the right stub member to create a conductive path, wherein the right stub member is only engaged with the right movable member when a second printed circuit board is inserted into the slot.

Example 171 This example includes the elements according to any one of examples 119 through 122, wherein the first electrical connector at least one of complies and/or is compatible with Joint Electron Device Engineering Council (JEDEC®) standard number JESD21-C, title: "Configurations for Solid State Memories", released January 2003, maintained by JEDEC® Solid State Memories committee JC-42 and/or later and/or related versions of this standard.

Example 172 This example includes the elements according to any one of examples 119 through 122, wherein the first electrical connector at least one of complies and/or is compatible with Joint Electron Device Engineering Council (JEDEC®) standard number JESD79-3F, title: "DDR3 SDRAM standard", released July 2012, maintained by JEDEC® Solid State Memories committee DRAM memories subcommittee JC-42.3 and/or later and/or related versions of this standard.

Example 173 A system including at least one device arranged to perform the method of any one of claims 33 to 62.

Example 174 A device including means to perform the method of any one of claims 33 to 62.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications.

What is claimed is:

1. An electrical connector comprising:

a housing defining a slot; and a pin comprising:

a stub member comprising a first portion and a second portion, the first portion to couple to a first printed circuit board; and a movable member comprising a first end, a second end, and a pivot point between the first and second ends, wherein:

the first end is operable to engage a second printed circuit board when the second printed circuit board is inserted into the slot;

the second end comprises a first elastic feature;

when the second printed circuit board is inserted into the slot, the movable member rotates about said pivot point such that at least a portion of the second end moves and is compressed against a rigid feature of said housing, and said first elastic feature moves to engage the second portion of the stub member to create a conductive path; and when the second printed circuit board is removed from the slot, the movable member rotates about said pivot point such that said first end moves to disengage the first elastic feature from the second portion of the stub member to break said conductive path.

2. The electrical connector of claim 1, wherein said movable member is configured such that when the second printed circuit board is inserted into said slot, at least a portion of the first end moves in a first direction and the second end moves in a second direction, wherein the first and second directions are different from one another.

3. The electrical connector of claim 1, wherein:

the first end of the movable member comprises a second elastic feature; and when the second printed circuit board is inserted into the slot, the second elastic feature is compressed between the first end of the movable member and the rigid feature of the housing, and causes the first end to move the first elastic feature to engage the second portion of the stub member; and the second elastic feature is configured to cause the first end to move to disengage the first elastic feature from the second portion of the stub member when the second printed circuit board is removed from said slot.

4. The electrical connector of claim 1, wherein the first elastic feature is configured to compressively engage the second portion of the stub member.

5. The electrical connector of claim 1, wherein said pivot point is defined by a pin extending through the movable member.

6. The electrical connector of claim 1, wherein the second printed circuit board is a dual inline memory module (DIMM).

7. A system comprising:

a first printed circuit board; and a first electrical connector coupled to the first printed circuit board, the first electrical connector comprising a housing defining a slot, and a pin, wherein the pin comprises:

a stub member comprising a first portion and a second portion, the first portion coupled to the first printed circuit board; and a movable member comprising a first end, a second end, and a pivot point between the first and second ends, wherein:

the first end is operable to engage a second printed circuit board when the second printed circuit board is inserted into the slot;

the second end comprises a first elastic feature;

when the second printed circuit board is inserted into the slot, the movable member rotates about said pivot point such that at least a portion of the second end moves and is compressed against a rigid feature of said housing, and said first elastic feature moves to engage the second portion of the stub member to create a conductive path; and when the second printed circuit board is removed from the slot, the movable member rotates about said pivot point such that said first end moves to disengage the first elastic feature from the second portion of the stub member to break said conductive path.

8. The system of claim 7, wherein said movable member is configured such that when the second printed circuit board is inserted into said slot, at least a portion of the first end moves in a first direction and the second end moves in a second direction, wherein the first and second directions are different from one another.

9. The system of claim 7, wherein the first end of the movable member comprises a second elastic feature, wherein:

the first end of the movable member comprises a second elastic feature; and when the second printed circuit board is inserted into the slot, the second elastic feature is compressed between the first end of the movable member and the rigid feature of the housing, and causes the first end to move the first elastic feature to engage the second portion of the stub member; and the second elastic feature is configured to cause the first end to move to disengage the first elastic feature from the second portion of the stub member when the second printed circuit board is removed from said slot.

10. The system of claim 7, wherein the first elastic feature is configured to compressively engage the second portion of the stub member.

11. The system of claim 7, further comprising a pivot point, wherein the movable member is configured to rotate about the pivot point when the second printed circuit is inserted in the slot such that said first elastic feature engages the second portion of said stub member.

12. The system of claim 7, wherein the second printed circuit board is a dual inline memory module (DIMM).

13. The system of claim 7, further comprising a second electrical connector.

14. The system of claim 13, wherein the first electrical connector is coupled to a first surface of the first printed circuit board and the second electrical connector is coupled to an opposing second surface of the first printed circuit board.

15. The system of claim 13, further comprising an integrated circuit module coupled to the first printed circuit board, the integrated circuit module further coupled to the second printed circuit board when the second printed circuit board is inserted in the slot.

16. The system of claim 15, wherein the integrated circuit module is a processor.

* * * * *